US011208602B2

(12) United States Patent
Frecon et al.

(10) Patent No.: US 11,208,602 B2
(45) Date of Patent: Dec. 28, 2021

(54) PROCESS FOR CONVERTING A FEEDSTOCK CONTAINING PYROLYSIS OIL

(71) Applicant: AXENS, Rueil-Malmaison (FR)

(72) Inventors: Jacinthe Frecon, Rueil-Malmaison (FR); Delphine Le Bars, Rueil-Malmaison (FR); Hong Duc Nguyen, Rueil Malmaison (FR)

(73) Assignee: AXENS, Rueil-Malmaison (FR)

( * ) Notice: Subject to any disclaimer, the term of this patent is extended or adjusted under 35 U.S.C. 154(b) by 0 days.

(21) Appl. No.: 16/924,765

(22) Filed: Jul. 9, 2020

(65) Prior Publication Data

US 2021/0009907 A1 Jan. 14, 2021

(30) Foreign Application Priority Data

Jul. 10, 2019 (FR) ..... 19/07.744

(51) Int. Cl.
*C10G 69/06* (2006.01)
*C10G 9/36* (2006.01)
(Continued)

(52) U.S. Cl.
CPC ..... *C10G 69/06* (2013.01); *C10G 9/36* (2013.01); *C10G 21/003* (2013.01); *C10G 45/16* (2013.01);
(Continued)

(58) Field of Classification Search
CPC .. C10G 47/26; C10G 67/0454; C10G 67/049; C10G 69/06
See application file for complete search history.

(56) References Cited

U.S. PATENT DOCUMENTS 7,449,103 B2 * 11/2008 Lott ..... B01J 8/226 208/108
2011/0198265 A1 * 8/2011 Colvar ..... C10G 67/049 208/56
(Continued)

FOREIGN PATENT DOCUMENTS

CN 103374395 A 10/2013

OTHER PUBLICATIONS

Nenad D. Ristic et al: "Compositional Characterization of Pyrolysis Fuel Oil from Naphtha and Vacuum Gas Oil", Energy & Fuels.,vol. 32, No. 2, Jan. 23, 2018 (Jan. 23, 2018), pp. 1276-1286, XP055680245, Washington, DC, US. ISSN: 0887-0624.
(Continued)

*Primary Examiner* — Renee Robinson
(74) *Attorney, Agent, or Firm* — Millen White Zelano and Branigan, PC; John Sopp

(57) ABSTRACT

The invention relates to a process for converting a feedstock comprising pyrolysis oil and a heavy hydrocarbon-based feedstock, with:

a) a step of hydroconversion in a reactor;
b) a step of separating the liquid effluent obtained from step a) into a naphtha fraction, a gas oil fraction, a vacuum gas oil fraction and an unconverted residue fraction;
c) a step of hydrocracking of the vacuum gas oil fraction;
d) a step of fractionating the hydrocracked liquid effluent obtained from step c) into a naphtha fraction, a gas oil fraction and a vacuum gas oil fraction;
e) a step of steam cracking of a portion of the naphtha fraction obtained from step d);
f) a step of fractionating at least a portion of the steam-cracked effluent obtained from step e);
g) a step in which the pyrolysis oil fraction obtained from step f) is sent into step a).

19 Claims, 4 Drawing Sheets

(51) Int. Cl.

| | |
|---|---|
| ***C10G 21/00*** | (2006.01) |
| ***C10G 45/16*** | (2006.01) |
| ***C10G 47/02*** | (2006.01) |

(52) U.S. Cl.

CPC ..... *C10G 47/02* (2013.01); *C10G 2300/107* (2013.01); *C10G 2300/1077* (2013.01); *C10G 2300/206* (2013.01); *C10G 2300/4081* (2013.01); *C10G 2400/02* (2013.01); *C10G 2400/20* (2013.01)

(56) References Cited

U.S. PATENT DOCUMENTS

| | | | | |
|---|---|---|---|---|
| 2018/0155633 | A1 | 6/2018 | Al-Ghamdi et al. | |
| 2018/0155639 | A1 | 6/2018 | Al-Ghamdi et al. | |
| 2018/0155641 | A1* | 6/2018 | Al-Ghamdi ..... | C10G 7/06 |
| 2018/0155643 | A1 | 6/2018 | Al-Ghamdi et al. | |
| 2019/0055482 | A1 | 2/2019 | Salazar-Guillen et al. | |

OTHER PUBLICATIONS

Search report in corresponding FR application FR 1907744 dated Mar. 27, 2020 (pp. 1-5).

* cited by examiner

PROCESS FOR CONVERTING A FEEDSTOCK CONTAINING PYROLYSIS OIL

TECHNICAL FIELD

The invention relates to the hydroconversion treatment of heavy hydrocarbon feedstocks, including at least one cut obtained from steam cracking.

PRIOR ART

The steam cracking of hydrocarbon-based feedstocks leads, in a known manner, to several cuts, of which the heaviest cut derived from the steam cracking unit is known as "pyrolysis oil" (or by its abbreviation "py-oil").

This cut is usually used as fuel, either internally in the refinery where the steam cracking unit is located, or externally, for example for power generating units, thus solely for the purpose of burning it to recover the combustion heat produced.

This cut contains high-temperature pyrolysis reaction products and in particular "refractory" heavy molecular structures such as "asphaltenes" and "resins".

"Asphaltenes" constitute a family of compounds that are soluble in aromatic and polyaromatic solvents and insoluble in aliphatic hydrocarbons (n-pentane, n-heptane, etc.). Their structure and their composition vary according to the origin of the petroleum feedstock, but certain atoms and groups of said structure are always present in variable proportions. Among these atoms, mention may be made of oxygen, sulfur, nitrogen and heavy metals, for instance nickel and vanadium.

The presence of numerous polycyclic groups gives the asphaltene molecules a highly aromatic nature. As a result of their insolubility in aliphatic hydrocarbons, and as a function of the more or less aromatic nature of the crude oil or of the petroleum cuts, asphaltenes may precipitate. This phenomenon gives rise to the formation of a deposit in the production lines and equipment (reactors, vessels, columns, exchanges, etc.). The asphaltenes content is generally expressed in terms of the content of insoluble asphaltenes in heptane, and is measured according to a method described in the standard NF-T60-115 of January 2002.

The "resins" are hydrocarbon-based compounds similar to asphaltenes, but they are soluble in solvents such as n-pentane or n-heptane, unlike asphaltenes. Resins typically consist of a condensed polycyclic nucleus, composed of aromatic and cyclane rings and of sulfide-based or nitrogenous heterocycles, with a lower molecular weight and a less condensed structure than that of asphaltenes.

It would be advantageous to find out how this pyrolysis oil could really be profitably exploited, rather than burning it. Certain documents make reference to the possible exploitation of this oil, or at the very least to its processing:

Thus, U.S. Pat. No. 7,951,745 describes the use of a soluble catalyst for hydrocracking a hydrocarbon-based feedstock rich in heavy polynuclear aromatics (or HPNA), preferentially used in a continuous reactor with a recirculation pump. The pyrolysis oil originating from a steam cracking unit is mentioned as being a feedstock that is useful for the use of said soluble catalyst.

Patent application FR-2 981 659 discloses a sequence of ebullated-bed hydroconversion treatments followed by a fixed-bed hydrotreatment with interchangeable reactors, in which the feedstock may comprise pyrolysis oil in the sense of a non-petroleum oil, i.e., for example, a pyrolysis oil derived from coal or from biomass, this type of feedstock being rich in oxygenated compounds.

Patent EP-3 260 520 relates to a conversion process comprising the following reaction sequence:

a) ebullated-bed hydroconversion of a feedstock, in the presence of hydrogen, in a hydroconversion section comprising at least one three-phase reactor, b) atmospheric fractionation of at least a portion of the hydroconverted liquid effluent obtained from step a) in an atmospheric fractionation section to produce a fraction comprising a gasoline cut and a gas oil cut, and an atmospheric residue;

c) fractionation under vacuum of at least a portion of the atmospheric residue obtained from step b) in a vacuum fractionation section to obtain a vacuum gas oil fraction comprising light vacuum gas oils (LVGO) and heavy vacuum gas oils (HVGO), and an unconverted vacuum residue fraction, d) deasphalting of at least a portion of the unconverted vacuum residue fraction obtained from step c) in a deasphalting section to obtain an asphaltene-depleted hydrocarbon-based cut known as the deasphalted oil, and residual asphalt, e) liquid-liquid extraction on the asphaltene-depleted hydrocarbon-based cut in an aromatics extraction section using a polar solvent to extract aromatics to produce an extract enriched in aromatics and resins and a raffinate depleted in aromatics and resins, the extract being sent at least partly as aromatic diluent to the inlet of the hydroconversion section.

This process does not seek to profitably exploit the pyrolysis oil.

The aim of the invention is then to develop a novel process for converting hydrocarbon-based feedstocks which enables the profitable exploitation of pyrolysis oil (obtained from a steam cracking unit, notably but not solely of petroleum origin). The aim of the invention is notably such a process which is, moreover, easy to implement without significantly complexifying the existing installations and/or without making the existing operating conditions of a refinery significantly more severe.

SUMMARY OF THE INVENTION

A subject of the invention is, firstly, a process for converting a first feedstock comprising pyrolysis oil obtained from a steam cracking unit and a second heavy hydrocarbon-based feedstock, said process comprising the following steps:

a) a step of hydroconverting said feedstocks in at least one reactor, in the presence of hydrogen and of at least one hydroconversion catalyst, with the reactor being fed with the first feedstock at a feed temperature T1 of between 80 and 200° C. and with the second feedstock at a feed temperature T2 strictly greater than 250° C., producing a hydroconverted liquid effluent;

b) a step of separating at least a portion of the hydroconverted liquid effluent obtained from step a) into at least a naphtha fraction, a gas oil fraction, a vacuum gas oil fraction and an unconverted residue fraction;

c) a hydrocracking step in a fixed-bed reactor in the presence of a catalyst for hydrocracking at least a portion of the vacuum gas oil fraction obtained from step b), producing a hydrocracked liquid effluent;

d) a step of fractionating at least a portion of the hydrocracked liquid effluent obtained from step c) into a naphtha fraction, a gas oil fraction and an unconverted vacuum gas oil fraction;

e) a step of steam cracking of at least a portion of the naphtha fraction obtained from step d) and optionally of a portion of the unconverted vacuum gas oil fraction obtained from step d) to obtain a steam-cracked effluent;

f) a step of fractionating at least a portion of the steam-cracked effluent obtained from step e) into an ethylene fraction, a propylene fraction, a butadiene and C4 olefin fraction, a pyrolysis gasoline fraction and a pyrolysis oil fraction;

g) a step in which at least a portion of the pyrolysis oil fraction obtained from step f) is sent, directly or indirectly (i.e. with one or more intermediate treatments), into the hydroconversion step a).

The first feedstock preferably comprises at least 50%, notably at least 80%, notably at least 90% or 95%, or even all of the pyrolysis oil.

For the purposes of the invention, the term "feed temperature" means the temperature at which the feedstock under consideration is introduced into the hydroconversion reactor. This does not prejudge the temperature at which the feedstock under consideration is at previously in the process. Thus, the first feedstock comprising pyrolysis oil is introduced into the reactor at a temperature of between 80 and 200° C., but it may previously have been at a temperature outside this temperature range and may optionally have undergone, notably, deliberate or natural intermediate cooling to be stored.

The term "at least one reactor" in step a) means that each of the two feedstocks is introduced into a reactor of a hydroconversion reaction section which may comprise one or more, and generally at least two, reactors in series. It may be the first reactor, the one that is the most upstream, or one of the following reactors, further downstream. The two feedstocks may be introduced into the same reactor or into different reactors of the reaction unit.

The second heavy hydrocarbon-based feedstock is introduced into the reactor at a temperature strictly greater than 250° C., but it may previously have been at a lower temperature and may have undergone heating to reach the desired feed temperature.

Preferably, the feed temperature T1 of the first feedstock is greater than or equal to 80° C., more preferentially greater than or equal to 90° C. and/or preferentially less than 180° C., more preferentially less than or equal to 150° C., even more preferentially less than or equal to 120° C., and the feed temperature T2 of the second feedstock is at least 300° C. and/or less than 450° C., notably between 300 and 400° C.

Preferably, the pyrolysis oil of the first feedstock is a petroleum oil; however, it may also totally or partly originate from a non-petroleum source (notably coal or biomass) in the sense that some of the feedstocks of the steam cracking, hydrocracking and hydroconversion units may originate from a non-petroleum source.

The invention thus relates to a hydroconversion process treating the pyrolysis oil obtained from a steam cracking unit and a heavy hydrocarbon-based feedstock, for example of vacuum gas oil residue type, notably obtained from the atmospheric distillation or vacuum distillation of crude oil.

The process thus enables the profitable exploitation of the pyrolysis oil by converting it into light finished products, by combining this oil (the "first" feedstock) with a conventional heavy hydrocarbon-based feedstock (the "second" feedstock) to make it undergo a hydroconversion (the term "conventional" means that it is the type of feedstock, illustrated later, which usually feeds hydroconversion devices/processes), but under specific conditions. Specifically, according to the invention, the temperatures at which each of the two types of feedstock are introduced into the hydroconversion reactor are controlled and selected, with a lower feed temperature for the pyrolysis oil than for the heavy hydrocarbon-based feedstock. This choice proved to make it possible to eliminate, or at the very least to minimize, the risk of formation of gums in or upstream of the reactor, which would originate from the polymerization of the olefins contained in the oil when it is introduced into the reactor at an excessively high temperature.

This choice also avoids the addition of a dedicated reactor to treat the olefins of the second charge, as may exist on current units treating charges with olefins.

This also prevents fouling of the equipment located upstream of the reactor when the two charges are heated together and then fed without care to the reactor, as may exist in current units treating charges with olefins.

The first and second feedstocks can separately feed the reactor, with two different injection zones. It is thus possible to fully control their respective feed temperatures, independently of each other.

However, hydrotreatment reactors may be designed with only one feedstock inlet, only one injection point. In this case notably, in order not to have to modify the design of the reactor, the two feedstocks may be injected via a common injection inlet, optionally with convergence of the streams of the two feedstocks in a common pipe emerging into said injection inlet, but the design of the common pipe (notably of short length) is then chosen so that the temperatures of each of the feedstocks, and the feedstocks themselves, do not have the time to become homogenized before they enter the reactor, or little enough time so that the first feedstock remains at most at the temperature threshold indicated above.

The feed temperature T2 of the second feedstock is either the temperature at which said feedstock leaves a prior treatment, or the temperature obtained by preheating said feedstock by any known means, for example using a preheating furnace. In the case of preheating of the second feedstock with a furnace, the first feedstock is not subjected to said preheating in a furnace, even in the case of a common injection pipe, so as not to raise its temperature and not to risk deteriorating the functioning of the furnace with deposits notably such as gums.

The feed temperature T1 of the first feedstock may be that of the pyrolysis oil when it emerges directly from the steam cracker (for example about 90 to 120° C.), or a slightly lower temperature, taking into account any losses of heat up to the inlet of the hydrotreatment reactor. It may also be preheated, where appropriate, by any known means other than a furnace.

The feed temperature of the first feedstock may be lower, notably when the pyrolysis oil has been previously stored, at the outlet of the steam cracker (for example about 70, 80 to 90° C.).

In general, it is thus generally advantageously between 80 or 90° C. and 120° C.

Advantageously according to the invention, during step g), the pyrolysis oil fraction obtained from step f) is sent to the hydroconversion step a), either directly or after at least one intermediate treatment such as deasphalting.

According to a variant, the first feedstock comprising pyrolysis oil obtained from a steam cracking unit is introduced at the end of the hydroconversion step a) (and not simultaneously with the second feedstock in the reactor or the first of the reactors or one of the successive reactors when there are several in series), for example to the inlet of the separating section which is at the start of the separation step b).

It is also possible, according to the invention, to delay the introduction of all or part of the first feedstock from the hydroconversion step a) into the separation step b): the pyrolysis oil is then introduced into the separating section or into the fractionating section of the separation step b) (generally an atmospheric fractionation followed by a vacuum fractionation).

This "delayed" introduction of the pyrolysis oil, at the end of step a) or during step b), also proved to be advantageous in terms of stabilization of the hydroconversion unit effluents, notably the heavier effluents (unconverted residue). Specifically, surprisingly, the presence of pyrolysis oil stabilizes the asphaltenes present in the effluents obtained from the hydroconversion step and prevents or limits their precipitation by means of their high content of resins and aromatics.

This is thus another type of profitable exploitation, where the pyrolysis oil is not (or not entirely) converted in the hydroconversion step, but at least partly in the hydrocracking step, while at the same time being used to stabilize the hydroconversion effluents between step a) and step c). The positive impact of the pyrolysis oil on the process as a whole is thus used.

According to the invention, it is also possible to introduce pyrolysis oil partly on starting the hydroconversion step a), to convert the pyrolysis oil at this stage, and also later, partly at the end of step a) or during step b), this time to stabilize the hydroconversion effluents. Preferably, in this case, the content of pyrolysis oil mixed with the stream to be stabilized, generally the unconverted residue, is greater than or equal to 10%, preferentially greater than or equal to 15%, preferentially greater than or equal to 20% by weight of the mixture and/or is less than or equal to 50% by weight, more preferentially less than or equal to 40% by weight, even more preferentially less than or equal to 30% by weight of the mixture.

Preferably, the hydroconversion step a) in the presence of hydrogen is performed in at least one ebullated-bed three-phase reactor.

It should be noted that the hydroconversion may be performed with a single reactor or with several reactors in series (just like the other process steps mentioning a reactor).

Preferably, the process according to the invention also comprises a step h) of deasphalting by liquid/liquid extraction of at least a portion of the unconverted residue fraction from step b), so as to obtain an asphalt phase and a deasphalted unconverted residue, said deasphalted unconverted residue being at least partly sent to the hydrocracking step c).

By returning the unconverted residue into the hydrocracking step, this deasphalting step h) makes it possible to increase the overall degree of conversion of the process of the invention.

The optional deasphalting step h) may be performed in two successive steps so as to obtain an asphalt phase, a light deasphalted unconverted residue and a heavy deasphalted unconverted residue, said light deasphalted unconverted residue being sent at least partly to the hydrocracking step c), said heavy deasphalted unconverted residue preferably being sent at least partly to step a) in the second feedstock.

In this variant of the two-step deasphalting, the light unconverted residue constitutes a feedstock that is easier to process in the hydrocracking step c) than the deasphalted unconverted residue obtained from the one-step deasphalting step, and the service life of the hydrocracking catalyst is thereby increased. Furthermore, the heavy deasphalted unconverted residue constitutes a feedstock which makes it possible to improve the performance qualities of the ebullated-bed hydroconversion step a) by stabilizing the asphaltenes. The overall performance of the process is thereby improved when compared with simple deasphalting, i.e. in one step.

Advantageously, the hydroconversion step a) may be performed with two ebullated-bed reactors between which is placed an inter-stage vessel, and said heavy deasphalted unconverted residue is introduced in the hydroconversion step a) into said inter-stage vessel. This introduction further "downstream" in the three devices in series (which may comprise more thereof) makes it possible to design the size of the reactors, and notably of the first (the most upstream) of the reactors just as needed.

Preferably, the process according to the invention may also comprise a step a') of deasphalting the pyrolysis oil obtained from the liquid/liquid extraction step f), so as to obtain an asphalt phase and a deasphalted pyrolysis oil, said deasphalted pyrolysis oil being at least partly sent to the hydroconversion step a) as first feedstock.

In a first variant, it is a "simple" extraction, i.e. in one step.

With this step a'), the deasphalted pyrolysis oil is a cut that is easier to process by hydroconversion than a pyrolysis oil obtained directly from steam cracking, since it has a reduced content of asphaltenes, which are a source of problem in hydroconversion units, since they tend to cause blockage of the pipes. By using at least a portion of this deasphalted oil to make the first feedstock of step a), the overall performance of the process according to the invention is improved.

This optional deasphalting step a') may, in a second variant, be performed by "double" liquid/liquid extraction, i.e. in two steps, so as to obtain an asphalt phase, a light deasphalted pyrolysis oil and a heavy deasphalted pyrolysis oil, said light deasphalted pyrolysis oil preferably being at least partly or totally sent to the hydrocracking step c), and said heavy deasphalted pyrolysis oil preferably being at least partly sent to the hydroconversion step a) in the first feedstock.

In this case, the heavy deasphalted pyrolysis oil obtained is a resin-rich cut. Now, the resins make it possible, to a certain extent, to stabilize the asphaltenes in the hydroconversion reactor and to avoid their precipitation. The presence of this heavy deasphalted oil in the first feedstock thus makes it possible to further increase the overall performance of the process when compared with the first variant of "simple" separation.

The process according to the invention may alternatively comprise a step i) of deasphalting by liquid/liquid extraction of the pyrolysis oil obtained from step f) and of at least a portion of the unconverted residue obtained from step b), so as to obtain an asphalt phase and a deasphalted pyrolysis oil cut, said deasphalted oil DAO cut being at least partly sent to the hydroconversion step a) in the first feedstock. This is a matter here of a "simple" extraction.

In this case, the deasphalted pyrolysis oil cut obtained from the mixing of the pyrolysis oil with the unconverted residue obtained from the hydroconversion step a) is an asphaltene-poor and resin-rich cut. This step i) makes it possible in a single deasphalting step to treat both the pyrolysis oil fraction and the unconverted residue obtained from step b), which is very advantageous.

The optional deasphalting step i) may also be performed by "double" liquid/liquid extraction, i.e. in two steps, so as to obtain an asphalt phase, a light deasphalted pyrolysis oil cut and a heavy deasphalted pyrolysis oil cut, said light deasphalted pyrolysis oil cut being at least partly sent to the hydrocracking step c), and said heavy deasphalted pyrolysis oil cut being at least partly or totally sent to the hydroconversion step a) in the first feedstock.

In this case of "double" extraction, it is seen that a single deasphalting unit enables the deasphalting of the unconverted residue and the pyrolysis oil, and their subsequent separation into three fractions: the asphalt which is profitably exploited in other units, the heavy deasphalted oil which is sent to the hydroconversion step a) and the light deasphalted oil which is sent to the hydrocracking step c). This solution is advantageous in that it avoids the need for two deasphalting units, one dedicated to the pyrolysis oil and the other to the unconverted residue.

Preferably, the hydroconversion step a) is performed in the presence of a colloidal or molecular catalyst, and of a porous supported catalyst. Specifically, the presence of a colloidal or molecular catalyst in the reaction zone makes it possible to treat the asphaltenes more efficiently, and thus to reduce the formation of coke precursors and of sediments. The use of a colloidal catalyst enables a reduction of the fouling of the equipment and an increased degree of conversion.

Optionally, the process according to the invention may also include at least one of the following additional steps:

- a hydrotreatment step j), performed in a reactor in the presence of at least one fixed-bed hydrotreatment catalyst, of at least a portion of the naphtha fraction obtained from step b), optionally followed by a step k) of recycling of at least a portion of the hydrotreated naphtha fraction obtained from step j) into the steam cracking step e);
- a hydrotreatment step l), performed in a reactor in the presence of at least one fixed-bed hydrotreatment catalyst, of at least a portion of the gas oil fraction obtained from step b), optionally followed by a step m) of recycling of at least a portion of the hydrotreated gas oil fraction obtained from step l) into the hydrocracking step c).

Advantageously, and as mentioned above, it is possible according to the invention to perform step a) with, in the first feedstock, at least partly, a pyrolysis oil obtained from steam cracking which has been subjected beforehand to at least one treatment step chosen from deasphalting and steam stripping and/or hydrogen stripping. In the case of stripping, a portion of the light compounds contained in the pyrolysis oil may be sent to another hydrocracking unit.

Advantageously, in another variant according to the invention, step a) can be carried out with, in the first charge, a so-called "full range" pyrolysis oil obtained from steam cracking, that is to say with a cut d pyrolysis oil without it being previously subjected to a treatment, separation, deasphalting and/or stripping step with steam and/or hydrogen. In this variant, all the compounds of the pyrolysis oil cut are recovered in the hydroconversion unit.

Preferably, the hydroconversion step a) is performed with a porous supported catalyst comprising an alumina support and at least one metal from group VIII chosen from nickel and cobalt, said element from group VIII being used in combination with at least one metal from group VIB chosen from molybdenum and tungsten.

Preferably, the hydroconversion step a) is performed with a solution of catalyst precursor comprising an organometallic compound or complex that is soluble in the second feedstock. Specifically, the precursor solution is to be mixed/dispersed in the feedstock carefully, usually in diluted form, and it is generally incompatible with dispersion in pyrolysis oil.

Thus, for example, and according to the invention, a solution of catalyst precursor may be used comprising an organometallic compound or complex that is soluble in the hydrocarbon-based feedstock, for example a molybdenum 2-ethylhexanoate complex containing about 15% by weight of molybdenum, which is mixed with at least a portion of the second feedstock from the hydroconversion step a).

Advantageously according to the invention, the hydroconversion step a) is performed at an absolute pressure of between 2 and 35 MPa, at a temperature of between 300 and 550° C., at an hourly space velocity (HSV) of between 0.05 $h^{-1}$ and 10 $h^{-1}$ and under an amount of hydrogen mixed with the feedstock of between 50 and 5000 normal cubic metres ($Nm^3$) per cubic metre ($m^3$) of liquid feedstock.

At least one of the steps a'), h) and i) of deasphalting by liquid/liquid extraction may be performed in one step in an extraction medium by means of an apolar solvent, so as to obtain an asphalt cut and a deasphalted cut.

At least one of the steps a'), h) and i) of deasphalting by liquid/liquid extraction may be performed in two steps in an extraction medium by means of a first polar or apolar solvent for the first step, and of a second apolar solvent or of a second polar solvent for a second step. It may also be performed using a mixture of apolar and polar solvents, so as to obtain an asphalt cut, a light deasphalted cut and a heavy deasphalted cut: the proportions of said polar solvent(s) and of said apolar solvent(s) in the solvent mixture are adjusted, for the first and for the second step, according to the properties of the feedstock and the desired asphalt yield.

At least one of the deasphalting steps a') and h) may be performed under subcritical conditions, namely under temperature conditions below the critical temperature of the solvent or solvent mixture. Alternatively, at least one of these steps may be performed under supercritical conditions (thus at temperatures above said critical temperature).

Advantageously, the polar solvents used in the deasphalting step a') and/or h) and/or i) are chosen from pure aromatic or naphtheno-aromatic solvents, polar solvents including hetero-elements or a mixture thereof or aromatic-rich cuts such as cuts obtained from fluidized-bed catalytic cracking (FCC), cuts derived from coal, from biomass or from biomass/coal mixtures.

Advantageously, the apolar solvents used in the deasphalting step a'), h) and/or i) are chosen from solvents composed of saturated hydrocarbons comprising a carbon number of greater than or equal to 2, preferably of between 2 and 9.

Advantageously, the apolar solvents used in the deasphalting step a') and/or h) and/or i) are chosen from propane, butane, pentane, hexane and heptane.

Advantageously, step a') and/or h) and/or i) is performed with a ratio of volume of the solvent to the volume of the feedstock of between 1/1 and 10/1, expressed in litres per litre.

Preferably, the proportion of pyrolysis oil of the first feedstock relative to the total feedstock of the hydroconversion step a) is greater than or equal to 5% by weight, preferably greater than or equal to 10% by weight, and/or preferably less than or equal to 50% by weight, notably less than or equal to 25% or 40% by weight.

On account of its contents of unsaturated compounds and of asphaltenes, the pyrolysis oil feedstock is difficult to treat in a hydroconversion unit: it is by adjusting the proportion of pyrolysis oil relative to the rest of the conventional feedstock of the hydroconversion reactor, so that it preferably remains less than 50% and rather between 5% and 25% by weight, that it is able to be done without having to modify the operating conditions of the hydroconversion, without operating difficulties.

The first feedstock may consist solely of pyrolysis oil obtained from steam cracking, of the same origin, or of several pyrolysis oils which have or have not undergone various treatments since the steam cracking from which they are obtained, with or without intermediate storage.

Preferably, the second feedstock of the hydroconversion step a) comprises hydrocarbons chosen from at least one of the following carbon-based/hydrocarbon compounds: hydrocarbons obtained from the atmospheric distillation or vacuum distillation of crude oil, residual fraction obtained from the direct liquefaction of coal, vacuum gas oil, residual fraction obtained from the direct liquefaction of lignocellulosic biomass alone or as a mixture with coal, residual petroleum fraction.

Preferably, the separation step b) comprises: —a first step of separating the effluent obtained from step a) to obtain at least one naphtha fraction and at least one gas oil fraction and a heavy liquid fraction boiling at a temperature above 300° C.; —a second step of separating said heavy liquid fraction boiling at a temperature above 300° C. to obtain at least one light liquid fraction boiling at a temperature of at most 565° C. of vacuum gas oil and a heavy liquid fraction boiling at a temperature of at least 500° C.

DESCRIPTION OF THE EMBODIMENTS

Figure 1:
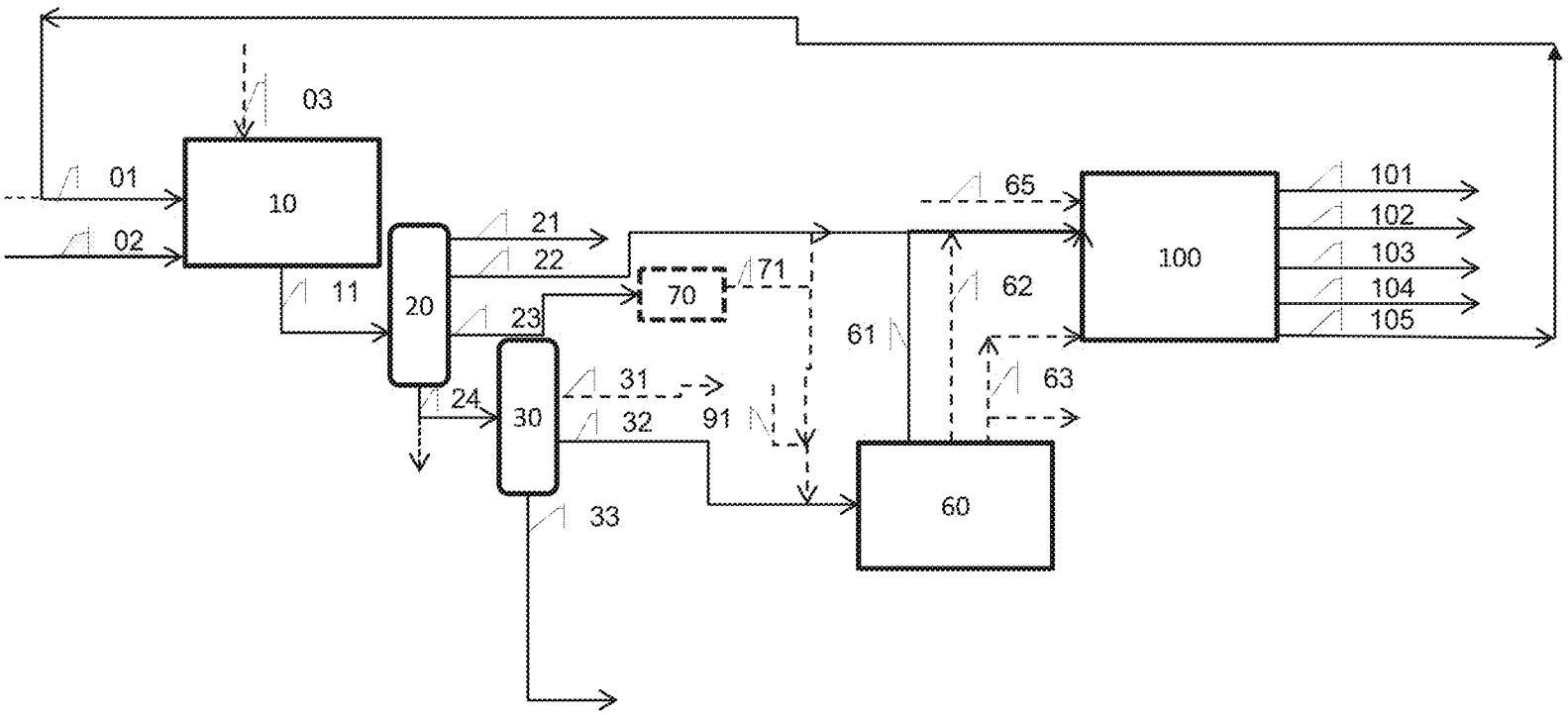
FIG. 1 illustrates the implementation of the process of the invention according to one embodiment.

Surprisingly, the invention has shown that a novel process makes it possible to profitably exploit as light finished products a feedstock comprising pyrolysis oil (abbreviated as "py-oil"), without moreover entailing any problems of implementation in a refinery installation.

The feedstock used for the hydroconversion step a) of the process according to the invention is described below:

The feedstock for the hydroconversion treatment of the process according to the invention is a mixture comprising at least one fraction of a pyrolysis oil cut obtained from a steam cracking unit (the "first" feedstock) and a feedstock (the "second" feedstock) consisting of "heavy" hydrocarbons with an initial boiling point of at least 300° C. The "initial boiling point" or IBP, the definition of which is as follows: The initial boiling point according to the ASTM standard identifies the temperature at which the first drop of condensed liquid appears during a distillation (the final boiling point identifying, for its part, the highest temperature during a distillation).

Preferably, the "second" charge consists of so-called heavy hydrocarbons having an initial boiling point of at least 520, preferably at least 550° C.

The second feedstock is advantageously chosen from the following feedstocks: a residual fraction resulting from the direct liquefaction of coal (atmospheric residue or vacuum residue resulting, for example, from the H-Coal™ process) or also an H-Coal™ vacuum gas oil or also a residual fraction resulting from the direct liquefaction of lignocellulose biomass alone or as a mixture with coal and/or a residual petroleum fraction. This type of feedstock is generally rich in impurities with contents of metals of at least 20 ppm, preferably at least 50 ppm, notably at least 100 ppm, notably at least 150 pm (weight). The sulfur content is at least 0.5%, notably at least 1% and notably greater than 2% by weight. The content of C7 asphaltenes is notably greater than 1%, notably between 1% and 40% and more preferably between 2% and 30% by weight, still more preferably between 5 and 30% weight.

Preferably, the Conradson carbon content in the second charge is typically greater than or equal to 10% by weight. The Conradson carbon content is defined by standard ASTM D 482 and represents for a person skilled in the art a well-known evaluation of the quantity of carbon residues produced after combustion under standard conditions of temperature and pressure.

Said second feedstock may be of petroleum origin of atmospheric residue or vacuum residue type resulting from "conventional" crude (API degree>20°), heavy crude (API degree between 10° and 20°) or extra-heavy crude (API degree<10°) or from crude oil. The feedstock may have different geographical and geochemical (type I, II, IIS or III) origins, with degrees of maturity and biodegradation which are also different.

The first feedstock is pyrolysis oil obtained, for example, from a steam cracker which processes naphtha or diesel or LPG (liquefied petroleum gas) or VGO (vacuum gas oil) or crude oil feedstocks, preferentially feedstocks of naphtha type. The pyrolysis oil typically contains molecules that are highly refractory with respect to cracking and heavy, and notably a large proportion of 300° C.+, typically more than 50% by volume.

The proportion of the pyrolysis oil fraction in the total feedstock of the hydroconversion step a) is advantageously greater than or equal to 5% by weight and/or advantageously less than or equal to 40% by weight. It is preferably between 5% and 25% by weight.

The content of C7 asphaltenes in the pyrolysis oil is typically greater than 15% by weight and more preferentially greater than 20% by weight, and less than or equal to 40% by weight. C7 asphaltenes are compounds known for inhibiting the conversion of residual cuts, both by their ability to form heavy hydrocarbon-based residues, commonly referred to as coke, and by their tendency to produce sediments which greatly limit the operability of the hydrotreating and hydroconversion units.

The Conradson carbon content in the pyrolysis oil is typically greater than or equal to 5% by weight and more preferentially greater than or equal to 15% or even 35% by weight. The Conradson carbon content is defined by the standard ASTM D 482 and represents, for a person skilled in the art, a well-known evaluation of the amount of carbon residues produced after a combustion under standard temperature and pressure conditions.

Typically, the pyrolysis oil contains unsaturated compounds. Their content is typically greater than or equal to 1% by weight, preferentially greater than 10% by weight and/or less than or equal to 30% by weight, preferentially less than or equal to 25% by weight. Said unsaturated compounds are formed in the steam cracking step. The pyrolysis oil has a content of less than or equal to 10% of saturated compounds, preferentially less than or equal to 5% of saturated compounds. The conventional vacuum residue feedstocks that are typical for a deep hydroconversion unit are chosen from feedstocks free of unsaturated compounds, since these compounds lead to the formation of gums which reduce the performance of the equipment.

Advantageously, the pyrolysis oil has a content of aromatic compounds and resins of greater than or equal to 10% by weight, preferentially greater than or equal to 25% by weight, more preferentially greater than or equal to 40% by weight and/or less than or equal to 90% by weight, preferentially less than or equal to 75% by weight. The aromatic compounds and resins of the pyrolysis oil are included among the "stabilizing" molecules, since they make it possible to maintain the asphaltene molecules in solution and reduce the precipitation of these molecules during the hydroconversion step, notably in ebullated-bed reactors.

As mentioned above, as a result of the contents of unsaturated compounds and of asphaltenes, the pyrolysis oil feedstock is difficult to treat in a hydroconversion unit; the proportion of oil in the hydroconversion feedstock is adapted in consequence.

The pyrolysis oil moreover has a low content of impurities, since the steam cracker feedstocks contain few impurities relative to a typical hydroconversion unit feedstock. The sulfur content in the pyrolysis oil is typically greater than 0.01% by weight and more preferentially greater than or equal to 0.02% by weight, and less than or equal to 1% by weight, preferentially less than or equal to 0.07% by weight.

The metal content of the pyrolysis oil is relatively low, typically less than 30 ppm by weight and preferentially less than or equal to 10 ppm by weight of metals.

The pyrolysis oil feedstock is treated according to the invention in the hydroconversion unit in the presence of the second feedstock described above.

In a first variant of the process according to the invention, with a deasphalting step h) performed in two steps, at least part of the heavy deasphalted unconverted residue obtained from step h) is sent upstream of the hydroconversion step a), as a mixture with the remainder of the feedstock comprising pyrolysis oil.

In a second variant of the process according to the invention with a deasphalting step a') performed in one or two steps, at least a portion of the heavy deasphalted oil obtained from step a') is sent into step a).

Each of the steps, including the optional steps, of the process according to the invention under consideration will be described hereinbelow.

Hydroconversion Step a):

The hydroconversion step a) may be performed in one or more ebullated-bed reactors. Mention may be made, for example, of the H-Oil technology licensed by Axens, the LC-Fining technology licensed by Chevron-Lummus-Global, which are described in numerous documents. The ebullated-bed technologies use supported catalysts in the form of extrudates, the diameter of which is generally about 1 mm or less than 1 mm. The catalysts remain inside the reactors and are not evacuated with the products.

The hydroconversion step a) may alternatively be performed in one or more "slurry" hydroconversion reactors. Mention may be made, for example, of the EST technology licensed by ENI, the VRSH technology licensed by Chevron-Lummus-Global, or the SRC-Uniflex technology licensed by UOP. The slurry hydroconversion technologies use a catalyst dispersed in the form of very small particles, the size of which is a few tens of microns or less (generally 0.001 to 100 μm). The catalysts, or the precursors thereof, are injected with the feedstock to be converted at the inlet of the reactors. The catalysts pass through the reactors with the feedstocks and the products undergoing conversion, and they are then entrained with the reaction products out of the reactors. They are found after separation in the heavy residual fraction, for instance the unconverted vacuum residue.

The hydroconversion step a) may alternatively be performed in one or more fixed-bed hydroconversion reactors. Mention may be made, for example, of the HYVAHL™ hydrotreatment process in at least two steps in which the first step comprises one or more HDM (hydrodemetallation) zones in fixed beds preceded by at least two HDM guard zones also known as "exchangeable reactors", also in fixed beds, but arranged in series so as to be used cyclically and to allow continuous operation with a high level of performance for fixed beds; and in which the effluent from the first step is passed, under hydrotreatment conditions, over a hydrotreatment catalyst in a second step. In this type of process, the conversion obtained may range up to 30-40% by weight relative to the total feedstock.

The hydroconversion step a) in the presence of hydrogen is preferentially performed in at least one three-phase reactor, said reactor containing at least one hydroconversion catalyst and functioning with an ebullated bed, with an ascending stream of liquid and gas. The reactor also includes at least one means for withdrawing said catalyst from said reactor, and at least one means for supplying fresh catalyst to the reactor, under conditions enabling the production of a liquid feedstock with reduced contents of Conradson carbon, metals, sulfur and nitrogen. Step a) of the process according to the invention is advantageously performed under the conditions of the H-Oil™ process, as described, for example, in the U.S. Pat. No. 4,521,295 or 4,495,060 or U.S. Pat. No. 4,457,831 or 4,354,852 or in the paper "Aiche, Mar. 19-23, 1995, Houston, Tex., paper number 46d, Second generation ebullated bed technology".

Step a) is performed so that the first feedstock comprising the pyrolysis oil or a fraction of the pyrolysis oil, and the second feedstock with an initial boiling point preferably of at least 300° C. are fed separately into the hydroconversion step a).

Preferentially, the first feedstock comprising the pyrolysis oil is injected directly into the reactor or into the second feedstock in the inlet line in the first hydroconversion reactor. In this latter case, the length of the inlet line is short enough for the first and the second feedstocks not to become homogenized, notably in terms of temperatures. As seen above, the pyrolysis oil under consideration may also be a pyrolysis oil fraction, in the case where it has undergone a treatment beforehand (when it is obtained from step a') or i) more particularly involving its deasphalting).

The hydroconversion step a) is performed in at least one hydroconversion reactor which is fed with the first feedstock (the first feedstock comprising the pyrolysis oil or the fraction of the pyrolysis oil cut preferentially preheated separately from the second feedstock). The temperature to which is preheated said first feedstock comprising the pyrolysis oil is preferentially greater than or equal to 80° C., preferentially less than or equal to 180° C., more preferentially less than or equal to 120° C., typically by means of a feedstock/effluent exchanger. The system for preheating the first feedstock does not include a furnace radiation zone.

The temperature to which the second feedstock is preheated before feeding the reactor in which the hydroconversion step is performed is preferentially greater than or equal to 250° C., and preferentially less than or equal to 400° C., for example between 300 and 400° C., typically by means of a series of feedstock/effluent exchangers followed by a furnace.

In all the variants of the process according to the invention, the hydroconversion catalyst of step a) preferentially comprises a porous supported catalyst and a colloidal or molecular catalyst. The colloidal or molecular catalyst provides catalytic activity additional to that of the porous supported catalyst.

The colloidal or molecular catalyst is typically formed in situ in the feedstock, before or during the introduction of the feedstock into the reactor of step a), notably into the ebullated-bed reactor. According to one embodiment, a catalyst precursor solution comprising an organometallic compound or complex that is soluble in the hydrocarbon-based feedstock is mixed with at least a portion of the second feedstock of the hydroconversion unit. Obtaining a very high dispersion of precursor in the feedstock before the formation of the catalyst allows maximum efficiency of the catalyst precursor. An example of a catalyst precursor is a molybdenum 2-ethylhexanoate complex containing about 15% by weight of molybdenum. It is used to form molybdenum disulfide. Other catalyst precursors are, inter alia, molybdenum or vanadium octoate, molybdenum or vanadium naphthanate, molybdenum hexacarbonyl, vanadium hexacarbonyl or iron pentacarbonyl. The hydrocracking catalyst is, for example, the product sold under the name HCAT by the company HTI.

The porous supported hydroconversion catalyst used in step a) of the process according to the invention is advantageously a granular catalyst about 1 mm in size when the reactor operates with an ebullated bed. It is usually in the form of extrudates or beads.

The porous supported hydroconversion catalyst used in step a) of the process comprises a support, the pore distribution of which is adapted to the treatment of the feedstock, which is preferably amorphous and which is, very preferably, alumina, a silica-alumina support also being envisageable in certain cases. The catalyst also contains at least one group VIII metal chosen from nickel and cobalt, preferably nickel. The group VIII element is preferably used in combination with at least one group VIB metal chosen from molybdenum and tungsten. Preferably, the group VIB metal is molybdenum.

Preferably, the porous supported hydroconversion catalyst comprises nickel as group VIII element and molybdenum as group VIB element. The nickel content is advantageously between 0.5% and 15%, expressed by weight of nickel oxide (NiO), and preferably between 1% and 10% by weight, and the molybdenum content is advantageously between 1% and 40%, expressed by weight of molybdenum trioxide ($MoO_3$), and preferably between 4% and 20% by weight. The catalyst may also advantageously contain phosphorus, the phosphorus oxide content preferably being less than 20% by weight and preferably less than 10% by weight.

The spent porous supported hydroconversion catalyst can, when it is used in an ebullated-bed reactor, be partly replaced with fresh catalyst by withdrawing the spent catalyst, preferably at the bottom of the reactor, and by introducing, either at the top or at the bottom of the reactor, fresh or regenerated or rejuvenated catalyst, preferably at regular time intervals and preferably sporadically or virtually continuously. The degree of replacement of the spent hydroconversion catalyst with fresh catalyst is advantageously between 0.01 kilogram and 10 kilograms per cubic metre of feedstock treated and preferably between 0.3 kilogram and 3 kilograms per cubic metre of feedstock treated. This withdrawing and this replacement are performed using devices which advantageously permit continuous functioning of this hydroconversion step.

The porous supported hydroconversion catalyst used in the hydroconversion step a) advantageously enables simultaneous demetallation and desulfurization, under conditions enabling a liquid feedstock to have a reduced content of metals, of Conradson carbon and of sulfur and which make it possible to obtain a high conversion into light products, that is to say in particular into naphtha and gas oil fuel fractions.

The colloidal or molecular catalyst and the porous supported catalyst may be used together in one or more hydroconversion step reactors.

In order to ensure a sufficiently dispersed mixture of the catalyst precursor solution in the second feedstock, the catalyst precursor solution is preferably premixed with a diluent composed of a hydrocarbon (for example vacuum gas oil, decantation oil, cycle oil or light gas oil or aromatic solvent) to obtain a dilute precursor solution. Typically, the dilute precursor solution is prepared at ambient temperature. Typically, the dilute precursor solution has a metal concentration of between 1.5% and 2.5% by weight. The dilute precursor solution may optionally undergo a step of heating at a temperature that is sufficient to bring about the release of hydrogen sulfide from hydrocarbon molecules containing sulfur, to bring about the transformation of the catalyst precursor into catalyst in metal sulfide form and/or into colloidal particles of extremely small size.

Typically, the catalyst precursor solution, optionally diluted, is then mixed with the second feedstock of the hydroconversion step, in amounts such that the metal content in the total feedstock is typically greater than or equal to 1 ppm, preferentially greater than or equal to 10 ppm, more preferentially greater than or equal to 50 ppm by weight, and preferentially less than or equal to 1000 ppm, preferentially less than or equal to 750 ppm, more preferentially less than or equal to 500 ppm by weight. The mixture consisting of the second feedstock and the precursor solution, optionally diluted, then optionally undergoes a step of heating to a temperature that is sufficient to bring about the release of hydrogen sulfide from hydrocarbon molecules containing sulfur to bring about the transformation of the catalyst precursor into catalyst in metal sulfide form and/or into colloidal particles of extremely small size (i.e. less than 100 nm, preferably less than about 10 nm, better still less than about 5 nm and better still less than about 1 nm).

The metal precursor addition system typically comprises a vessel into which the catalytic precursor solution is loaded and the facilities necessary for performing optional dilution with a hydrocarbon. The system is preferentially located downstream of the ebullated-bed reactor(s), depending on the need. Finally, it advantageously comprises one or more preheating zones for bringing about the decomposition of the catalyst precursor composition and/or for making the feedstock and/or the diluent release sulfur which can be combined with the metal.

Step a) of hydroconversion of the feedstock according to the invention is generally performed in a reactor operating at an absolute pressure of between 2 and 35 MPa, preferably between 5 and 25 MPa and with preference between 6 and 20 MPa, at a temperature of between 300 and 550° C. and preferably between 350 and 500° C. The hourly space velocity (HSV) and the partial pressure of hydrogen are parameters that are chosen as a function of the characteristics of the product to be treated and of the desired conversion. Preferably, the HSV is between 0.05 $h^{-1}$ and 10 $h^{-1}$ and preferably between 0.1 $h^{-1}$ and 5 $h^{-1}$. The amount of hydrogen mixed with the feedstock is preferably between 50 and 5000 normal cubic metres ($Nm^3$) per cubic metre ($m^3$) of liquid feedstock, preferably between 100 and 2000 $Nm^3/m^3$ and very preferably between 200 and 1000 $Nm^3/m^3$.

Step a) is advantageously performed in at least one, preferentially two, or even more than two ebullated-bed three-phase hydroconversion reactors in series, preferably one or more three-phase hydroconversion reactors with intermediate decanting vessels. Each reactor advantageously includes a recirculation pump which makes it possible to maintain the catalyst in an ebullated bed by continuous recycling of at least a portion of a liquid fraction advantageously withdrawn at the top of the reactor and reinjected at the bottom of the reactor.

Separation Step b):

The effluent obtained from the hydroconversion step a) then undergoes, in accordance with step b) of the process according to the invention, a separation step to obtain a light liquid fraction boiling at a temperature below 300° C., and a heavy liquid fraction boiling at a temperature of at least 300° C. Alternatively, the light liquid fraction obtained may boil at a temperature below 350° C. whereas the heavy liquid fraction obtained may boil at a temperature of at least 350° C. Preferentially, the light liquid fraction obtained may boil at a temperature below 375° C. whereas the heavy liquid fraction obtained may boil at a temperature of at least 375° C. These temperatures correspond to what is known as the cut point between the two light and heavy fractions.

Preferably, this separation first comprises one or more flash vessels in series and preferably a sequence of two successive flash vessels.

The light fraction directly obtained at the outlet of the separation step b) is then advantageously separated from the light gases comprising hydrogen and from the gas fractions including 1 to 4 carbon atoms, to obtain the light liquid fraction boiling at a temperature below 300° C., by any separation means known to a person skilled in the art, for instance by passing through a flash vessel, so as to recover the hydrogen gas, which is advantageously recycled into the hydroconversion step a).

Said light liquid fraction, advantageously separated from said light gases and boiling at a temperature below 300° C., preferably below 350° C. and preferably below 375° C., contains the dissolved light gases (C5+), a fraction boiling at a temperature below 150° C. corresponding to the naphthas, an optional fraction boiling between 150 and 250° C. corresponding to the kerosene fraction and at least a portion of the gas oil fraction boiling between 250 and 375° C. Said light liquid fraction is advantageously sent to a separation step, preferably in a distillation column, to separate therefrom said naphtha, kerosene and gas oil fractions.

The heavy liquid fraction boiling at a temperature above 300° C., preferably above 350° C. and preferably above 375° C., contains at least a portion of the gas oil fraction boiling between 250 and 375° C., a fraction boiling between 375 and 540° C., known as the vacuum gas oil, and a fraction boiling at a temperature above 540° C., known as the unconverted vacuum residue. The heavy liquid fraction thus comprises at least a portion of the middle gas oils and preferably at least a portion of the gas oil fraction boiling at a temperature of between 250 and 375° C.

In one variant of the process according to the invention, the heavy liquid fraction is advantageously subjected to a steam and/or hydrogen stripping step before being sent to the deasphalting step c) according to the invention. This step enables the removal, at least partly, of the vacuum gas oil (vacuum gas oil or VGO) fraction contained in the heavy liquid fraction.

In the first and third variant of the process according to the invention, at least a portion of the heavy liquid fraction boiling at a temperature above 500° C., preferably above 540° C., resulting from step b) is subjected to a deasphalting step h) or i).

Deasphalting Step a'), h) and i):

The deasphalting step a') and/or h) and/or i) involves placing the cut to be deasphalted in contact with at least one solvent, or even a solvent mixture, in an extraction medium. The nature of the solvent and/or the proportions of the solvent mixture are adjusted according to the properties of the feedstock and the desired degree of asphalt extraction.

Depending on the solvent used, the yield of deasphalted cut and the quality of this cut may vary. By way of example, on changing from a solvent containing three carbon atoms to a solvent containing seven carbon atoms, the yield of deasphalted cut increases but, in counterpart, the contents of impurities (asphaltenes, metals, Conradson carbon, sulfur, nitrogen, etc.) also increase.

Moreover, for a given solvent, the choice of the operating conditions, in particular the temperature and the amount of solvent injected, has an impact on the yield of deasphalted cut and on the quality of this cut. A person skilled in the art can select the optimum conditions for obtaining an asphaltene content of less than 3000 ppm.

According to the invention, the deasphalting step a') and/or h) and/or i) is preferentially performed under conditions for producing a deasphalted cut (DAO) containing at most 10 000 ppm by weight of asphaltenes, preferably at most 2000 ppm by weight of asphaltenes.

The deasphalting step a') and/or h) and/or i) may be performed either in one step or in two steps.

The use of the one-step deasphalting step is known as "conventional deasphalting". The principle of this process is based on a separation by precipitation of the feedstock to be treated in two phases:

- a "deasphalted oil" or "oil matrix" or "oil phase" or DAO phase;
- and an "asphalt phase" or occasionally "pitch phase", containing, inter alia, refractory molecular structures. Asphalt, due to its mediocre quality, is a disadvantageous product for refining schemes, which it is advisable to minimize.

Preferentially, step a') and/or h) and/or i) of deasphalting by liquid/liquid extraction performed in one step is performed using an apolar solvent, so as to obtain an asphalt-rich asphalt cut and an asphalt-poor DAO deasphalted oil cut.

The use of the two-step deasphalting step is referred to hereinbelow as "selective deasphalting". Compared with conventional deasphalting, the deasphalting process performed in two steps enables selective removal of the "final" asphalt fraction, i.e. the fraction specifically containing the most refractory structures of the feedstock.

When the deasphalting step is performed in two steps, a portion of the polar structures, such as the heavy resins and the asphaltenes which are the main constituents of the asphalt phase, can be maintained in solution in the DAO oil produced. Adjusting the nature and the properties of the solvent(s) used in the first and the second step makes it possible to select the polar structures that remain solubilized in the DAO oil matrix.

Selective deasphalting thus makes it possible to selectively extract from the fraction treated in the deasphalting step only a portion of the asphalt it contains. Preferentially, the most polar and the most refractory structures are extracted into the asphalt phase. The asphalt extracted according to the process of the invention corresponds to the final asphalt essentially composed of the most refractory polyaromatic and/or heteroatomic molecular structures.

Preferentially, when the deasphalting step a') and/or h) and/or i) is performed in two steps, the first deasphalting step produces an asphalt cut and a deasphalted oil DAO. Advantageously, the second deasphalting step treats said deasphalted oil DAO obtained from the first step. Advantageously, said second deasphalting step produces a light deasphalted oil DAO and a heavy deasphalted oil DAO.

The yield of DAO oil of the deasphalting step is expressed by the following relationship:

Yield of DAO oil=deasphalted oil DAO cut flow rate/treated fraction flow rate

The result may be given as an absolute value (between 0 and 1) or as a percentage (between 0% and 100%).

The flow rate of the deasphalted oil cut consists of the sum of the flow rate of the light deasphalted oil cut and of the heavy deasphalted oil cut, when the deasphalting is performed in two steps.

The asphalt yield is correlated with the DAO oil yield by the following relationship:

Asphalt yield=100−[DAO oil yield] or 1−[DAO oil yield]

The result may be given as an absolute value (between 0 and 1) or as a percentage (between 0% and 100%).

Selective deasphalting has the advantage of allowing an improvement in the yield of deasphalted oil DAO relative to conventional deasphalting. For a given heavy liquid fraction, for which the yield of DAO oil obtained has reached a maximum at 75% (extraction with normal heptane), selective deasphalting makes it possible to cover, by adjusting the proportion of polar solvent and of apolar solvent, the range 75%-99.9% for yield of deasphalted oil DAO.

The yield of deasphalted oil DAO is advantageously between 10% and 70%, preferably between 10% and 50%, and more preferably between 10% and 35%. The asphalt yield obtained is advantageously less than or equal to 70%, preferably less than or equal to 50% and preferably less than or equal to 35% by weight.

The selective deasphalting step a' and/or h) and/or i) may be performed in one or more extraction columns, preferably in a mixer-decanter. This step is performed by liquid/liquid extraction, in one step or in two steps according to the implementation chosen. The liquid/liquid extraction of step a') and/or h) and/or i) is performed under conditions which are subcritical for the solvent or solvent mixture, i.e. at a temperature below the critical temperature of the solvent or solvent mixture. The extraction temperature is advantageously between 50 and 350° C., preferably between 90 and 320° C., more preferably between 150 and 310° C., and the pressure is advantageously between 0.1 and 6 MPa.

The ratio of the volume of the solvent mixture according to the invention (volume of solvent) to the mass of the heavy liquid fraction is generally between 1/1 and 10/1, preferably between 2/1 and 8/1, expressed in litres per litre.

Advantageously according to the invention, the polar solvents used in the deasphalting step a' and/or h) and/or i) are chosen from naphtheno-aromatic or pure aromatic solvents, polar solvents including heteroelements, or a mixture thereof, or cuts rich in aromatics, such as cuts resulting from FCC or cuts derived from coal, biomass or a biomass/coal mixture.

Advantageously according to the invention, step a') and/or h) and/or i) is performed with a ratio of volume of the solvent to the volume of the feedstock of between 1/1 and 10/1, expressed in litres per litre.

Advantageously according to the invention, the apolar solvent(s) used in the deasphalting step a') and/or h) and/or i) are chosen from solvents composed of saturated hydrocarbons. Said saturated hydrocarbons comprise a carbon number greater than or equal to 2, preferably between 2 and 9. These saturated hydrocarbon solvents are used pure or as a mixture (for example: mixture of alkanes and/or of cycloalkanes or else of light petroleum cuts of naphtha type).

Advantageously, according to the invention, the apolar solvents used in the deasphalting step a') and/or h) and/or i) are chosen from propane, butane, pentane, hexane and heptane.

Preferably, the deasphalting step a') and/or h) and/or i) is performed in two steps, using a first apolar solvent for the first step and a second apolar solvent for the second step. Said first and second apolar solvents are preferably chosen from propane, butane, pentane, hexane and heptane. According to a preferred variant, the first and the second apolar solvents consist of propane.

In the second deasphalting step, the products that it is desired to extract from the heavy fraction preferentially have a boiling point higher than the boiling point of the solvent, so as to avoid a loss of yield during the separation of the solvent from the light deasphalted oil after the extraction. Specifically, during the separation of the solvent and of the light deasphalted oil, any compound with a boiling point lower than the boiling point of the solvent will inevitably leave with the solvent, and will thus lower the amount of light deasphalted oil obtained.

The polar solvent used may be chosen from pure aromatic or naphtheno-aromatic solvents, polar solvents including hetero-elements, or a mixture thereof. The aromatic solvent is advantageously chosen from monoaromatic hydrocarbons, preferably benzene, toluene or xylenes, alone or as a mixture; diaromatic or polyaromatic hydrocarbons; naphtheno-aromatic hydrocarbons such as tetralin or indane; heteroaromatic (oxygen-based, nitrogen-based or sulfur-based) aromatic hydrocarbons or any other family of compounds having a more polar nature than saturated hydrocarbons, for instance dimethyl sulfoxide (DMSO), dim ethylformamide (DMF) or tetrahydrofuran (THF).

The polar solvent used in the process according to the invention may also be an aromatic-rich cut. The aromatic-rich cuts according to the invention may be, for example, cuts obtained from FCC (fluid catalytic cracking) such as LCO (light cycle oil).

Preferably, the polar solvent used is a monoaromatic hydrocarbon, pure or as a mixture with another aromatic hydrocarbon.

Optionally, at least a portion of said deasphalted oil DAO cut obtained from step h) performed in one step is sent, optionally as a mixture with at least a portion, and preferably all, of the vacuum gas oil fraction obtained from step b) into the hydrocracking step c).

Optionally, at least a portion of the heavy deasphalted oil DAO cut obtained from step h) performed in two steps is recycled upstream of the hydroconversion step a) and at least a portion of the light deasphalted oil cut obtained from step h) performed in two steps is sent, optionally as a mixture with at least a portion, and preferably all, of the vacuum gas oil fraction obtained from step b) into the hydrocracking step c).

In one variant, said deasphalting step is performed on a feedstock after a steam stripping and/or hydrogen stripping step.

In one variant, a portion of the atmospheric residue obtained from step b) is sent directly to the deasphalting step h) or i).

Hydrocracking Step c):

Step c) of hydrocracking at least a portion of the vacuum gas oil fraction obtained from step b), and optionally of a second cut, is performed in a reactor comprising at least one fixed-bed hydrocracking catalyst.

Said second optional cut comprises one or more other feedstocks typically chosen from straight-run distillation vacuum gas oil ("straight-run" VGO) and light vacuum distillates (or "light vacuum gas oil", LVGO) and heavy vacuum distillates ("heavy vacuum gas oil" or HVGO) obtained at the outlet of the vacuum fractionation, and also cuts originating from other refinery units, such as cocker unit heavy and light gas oil, or gas oil from the hydroconversion step.

When the hydrocracking step c) treats a stream comprising a pyrolysis oil fraction, the hydrocracking reactor is then advantageously fed with this fraction separately from the rest of the feedstocks. The optional deasphalting steps described previously may, in point of fact, generate streams which comprise a pyrolysis oil fraction and which are liable to be sent to the hydrocracking step. It is notably the optional steps a') and i) which generate, respectively, a light deasphalted pyrolysis oil and a light deasphalted pyrolysis oil cut when they are performed by "double" liquid/liquid extraction. It is also the optional deasphalting step h) which may be performed in two successive steps so as to obtain a light deasphalted unconverted residue which may contain a pyrolysis oil fraction in the specific case where the pyrolysis oil is introduced late in part at the end of step a) or during step b) to stabilize the hydroconversion effluents.

When the hydrocracking step c) treats a stream comprising a pyrolysis oil fraction, the stream comprising the pyrolysis oil fraction is then preheated to a temperature preferentially greater than or equal to 80° C., more preferentially greater than or equal to 90° C., and/or preferentially less than or equal to 180° C., more preferentially less than or equal to 150° C., even more preferentially less than or equal to 120° C., typically by means of a feedstock/effluent exchanger. The system for preheating this feedstock does not include a furnace radiation zone.

The temperature to which the rest of the feedstocks are preheated before feeding the reactor in which the hydrocracking step is performed is preferentially greater than or equal to 250° C., and preferentially less than or equal to 400° C., for example between 300 and 400° C., typically by means of a series of feedstock/effluent exchanges followed by a furnace.

When the hydrocracking step c) treats a stream comprising a pyrolysis oil fraction, the stream comprising the pyrolysis oil fraction is introduced into a reactor of a hydrocracking reaction section, which may comprise one or more steps, and, in each step, one or more, and generally at least two, reactors in series. The introduction may take place in the various steps, notably in the first reactor, the one which is the most upstream, or in one or more following reactors, further downstream. The two feedstocks may be introduced into the same reactor or into different reactors of the reaction unit. The introduction preferentially takes place in the first reactor of the first step or in the first reactor of the second step.

The hydrocracking step c) advantageously treats the diesel fraction obtained from the hydroconversion step a).

The hydrocracking step c) may be performed as a "one-through" step, first including thorough hydrorefining, the aim of which is to perform thorough hydrodeazotization and desulfurization of the feedstock, before the effluent is totally sent onto the actual hydrocracking catalyst, in particular in the case where said catalyst includes a zeolite. Optionally, a portion of the unconverted effluent may be recycled into the inlet of the hydrocracking step c).

Alternatively, according to a preferred variant, the hydrocracking step c) may be performed "in two stages", such that the aim of the first stage, like in the "one-through" process, is to perform the hydrorefining of the feedstock, but also to achieve a conversion of said feedstock generally of the order of 30% to 60% by weight. In the second step of the two-stage hydrocracking process, only the fraction of the feedstock not converted during the first stage is generally treated. The aim of the two-stage process is to achieve an overall conversion of the feedstock generally of the order of 60% to 99.9% by weight.

Conventional hydrorefining catalysts generally contain at least one amorphous support and at least one hydro-dehydrogenating element (generally at least one non-noble element from groups VIB and VIII, and usually at least one element from group VIB and at least one non-noble element from group VIII).

The supports that may be used in the hydrorefining catalyst, alone or as a mixture, are, for example, alumina, halogenated alumina, silica, silica-alumina, clays (chosen, for example, from natural clays such as kaolin or bentonite), magnesia, titanium oxide, boron oxide, zirconia, aluminium phosphates, titanium phosphates, zirconium phosphates, charcoal or aluminates. It is preferred to use supports containing alumina, in all the forms known to those skilled in the art, and even more preferably aluminas, for example gamma-alumina.

The operating conditions of the hydrocracking step c) are adjusted so as to maximize the production of the desired cut, while at the same time ensuring good operability of the hydrocracking unit. The operating conditions used in the reaction zone(s) are generally an average temperature of the catalytic bed (WABT or "weighted average bed temperature") of between 300 and 550° C., preferably between 350 and 500° C.

The pressure is generally between 5 and 35 MPa, preferably between 6 and 25 MPa. The hourly space velocity HSV (flow rate of feedstock/volume of catalyst) is generally between 0.1 and 10 $h^{-1}$, preferably between 0.2 and 5 $h^{-1}$.

An amount of hydrogen is introduced such that the volume ratio in $m^3$ of hydrogen per $m^3$ of hydrocarbon at the inlet of the hydrocracking step is between 300 and 2000 $m^3/m^3$, usually between 500 and 1800 $m^3/m^3$, preferably between 600 and 1500 $m^3/m^3$.

The hydrocracking catalysts used in the hydrocracking processes are generally of the bifunctional type combining an acid function with a hydrogenating function. The acid function may be provided by supports having a large surface area (150 to 800 $m^2 \cdot g^{-1}$) and having surface acidity, such as halogenated (notably chlorinated or fluorinated) aluminas, combinations of boron and aluminium oxides, amorphous silicas/aluminas, known as amorphous hydrocracking catalysts, and zeolites. The hydrogenating function may be provided either by one or more metals from group VIII of the Periodic Table of the Elements or by a combination of at least one metal from group VIB of the Periodic Table and at least one metal from group VIII.

The hydrocracking catalyst may also include at least one crystalline acid function such as a zeolite Y, or an amorphous acid function such as a silica-alumina, at least one support and a hydrodehydrogenating function.

Optionally, it may also include at least one element chosen from boron, phosphorus and silicon, at least one group VIIA element (for example chlorine or fluorine), at least one group VIIB element (for example manganese), at least one group VB element (for example niobium).

Steam Cracking Step e):

The steam cracking step e) consists of the pyrolysis of saturated hydrocarbons obtained from natural gas or from petroleum in the presence of steam, in order to produce unsaturated, aliphatic or aromatic hydrocarbon cuts. Said cuts are then used for the synthesis of a large number of products, for instance polyethylene or propylene. Typically, in the hydrocracking step, the feedstock is introduced into at least one steam cracking furnace, in the presence of steam, to produce an effluent, containing at least light olefins (light olefins comprising at least one of the C2 to C4 olefins), C5+ hydrocarbons; and to separate from the effluent a first fraction which comprises the light olefins, and a second fraction which comprises the C5+ hydrocarbons.

Advantageously, the steam cracking unit treats a feedstock of naphtha and optionally diesel type in the scheme and the adapted operating conditions known to those skilled in the art.

Advantageously, the steam cracking unit treats the naphtha and optionally diesel cuts obtained from the preceding steps of the process according to the invention: notably, the naphtha obtained from the hydroconversion unit of step a) and/or the naphtha and/or optionally the diesel obtained from the hydrocracking step c), in the presence of an external naphtha feedstock.

Typically, the residence time in the steam cracking furnace is limited so as to limit the formation of heavy products. Furthermore, quenching of the effluent is established so as to fix the composition of the effluent at the outlet of the furnace.

Typically, the temperature at which the steam cracking furnaces are operated depends on the nature of the feedstock. Preferably, the steam cracking furnaces are adapted to treat a feedstock of naphtha type.

In all the variants of the process according to the invention, the steam cracking step e) is fed with the gas oil cut obtained from fractionation of the effluent from the hydrocracking step c) and, optionally, with the gas oil cut obtained from fractionation of the hydroconversion step a) after an optional hydrotreatment step j).

Optionally, the steam cracking step e) is fed with unconverted vacuum diesel obtained from the hydrocracking step c). This feedstock is particularly advantageous to treat in the steam cracker when the hydrocracking unit is a "one-through" unit, with or without recycling of a portion of the unconverted effluent.

In the different variants of the process according to the invention, the feedstocks for the steam cracking unit may comprise external feedstocks, corresponding to dedicated furnaces or furnaces in common with the furnaces treating the feedstocks produced by the steps of the process according to the invention. Said external feedstocks are quite varied and range from light saturated hydrocarbons such as ethane, propane or ethane-propane mixtures, to more or less heavy petroleum cuts such as petrochemical naphtha, gas oils or vacuum gas oils, and even optionally crude oil.

Typically, the steam cracking step is performed in an installation which is composed of a certain number of furnaces, quenching boilers and a fractionation train. The hydrocarbon-based feedstock enters the hot section of the unit via the convection zone A of the furnace where it is preheated, and it is then mixed with steam which is also preheated in this same zone; the hydrocarbons and the water then pass through the actual radiation zone of said furnace B where the rapid temperature rise and the pyrolysis reactions take place. At the outlet of the furnace, the effluents are, in order to avoid any subsequent reaction, fixed in their kinetic evolution possibilities by abrupt quenching generally performed in two stages: a first indirect quenching with water, followed by direct quenching using the heavy residue pyrolysis byproduct. The effluents are then transferred into a primary fractionating tower F which separates out at the bottom a heavy residue known as the "pyrolysis oil" and, by withdrawals, a steam cracking gasoline fraction and water, whereas the light pyrolysis products leave at the top in gaseous form.

After compression, washing with sodium hydroxide (intended to remove $H_2S$ and the acidic gases) and drying, these light effluents then enter the cold section of the unit which may be designed in several ways, but which ensures the separation of the hydrogen, ethylene at 99.9% (by mass), propylene at 95% which may, totally or partly, be brought to 99.5% (by mass), a C4 cut containing 25% to 50% (by mass) of butadiene, from the complementary fraction of the steam cracking gasoline rich in aromatic hydrocarbons.

Definitions

In the present text, "naphtha" denotes a petroleum cut whose lightest constituents contain 5 carbon atoms and whose final boiling point may range up to about 200° C. A distinction is made according to their distillation temperatures between light naphthas, the final boiling point of which is between 100° C. and 140° C., and heavy naphthas, the final boiling point of which is at about 200-220° C.

In the present text, the term "gas oil" denotes liquid petroleum fractions characterized in particular by their distillation range. A distinction is made between light or atmospheric gas oils distilling between 250° C. and 350° C., and heavy or "vacuum" gas oils, with boiling points of between 350 and 450° C. or even 500° C.

In the present text, the term "hydrocracking" covers cracking processes comprising at least one step of converting feedstocks using at least one catalyst in the presence of hydrogen.

In the present text, the term "colloidal catalyst" denotes a catalyst having colloidal-sized particles, for example less than or equal to about 100 nm in diameter, more preferentially less than or equal to about 5 nm in diameter, and most preferably less than or equal to about 1 nm in diameter. The term "colloidal catalyst" comprises, without being limited thereto, "molecular" catalysts.

In the present text, the term "molecular" catalyst denotes a catalyst which is essentially "dissolved" or totally dissociated from other catalytic compounds or molecules in a cut in which the catalyst is liable to be found. This term also refers to very small catalyst particles which contain only a few catalyst molecules joined together (for example 15 molecules or less).

FIG. 1 presents, for illustrative purposes, the implementation of the process according to one embodiment of the invention. Step a) of hydroconversion of the first feedstock 01 consisting of pyrolysis oil is performed in the reaction section 10 including, for example, at least one ebullated bed. A second feedstock 02 consisting, for example, of hydrocarbons of vacuum residue type obtained from a VR (vacuum residue) crude oil distillation, is also treated in step a), but it is fed into the first reactor separately from the first feedstock. The hydroconversion step a) is preferentially performed in the presence of a colloidal or molecular catalyst, obtained by adding a catalytic precursor 03 to the reaction section. The deep hydroconversion unit 10 refines and cracks the feedstock as an effluent 11 comprising significant amounts of gases 21, light naphtha (LN) and heavy naphtha (HN) 22, gas oil (GO) 23 and vacuum gas oil (VGO) as one or two light vacuum gas oil (LVGO) fractions 31 and heavy vacuum gas oil (HVGO) fractions 32. These various products are separated in step b) comprising an atmospheric fractionation section 20 followed by a vacuum fractionation section 30. At the bottom of the vacuum distillation, there remains an unconverted vacuum residue (VR) stream 33 which is typically profitably exploited as fuel.

The hydrocracking step c) is performed in a fixed-bed hydrocracking unit (HCK) 60. This unit enables conversion of at least a portion of the vacuum gas oil (VGO) 31 and 32 obtained from the hydroconversion unit, and also, for example, SR-VGO (straight-run vacuum gas oil, which is a vacuum gas oil obtained by direct distillation of crude oil) 91 and other compatible feedstocks. The hydrocracking step c) produces an effluent comprising significant amounts of naphtha 61, gas oil 62 and unconverted vacuum gas oil 63.

In the process according to the invention, the unconverted vacuum gas oil 63 may be sent to the steam cracking step e) when the hydrocracking step c) is performed as a one-through step. In another variant, when the hydrocracking step c) is performed in two steps with the objective, for example, of maximizing the production of naphtha and/or optionally of gas oil, then it is the naphtha and/or optionally the gas oil obtained from step c) that is sent to the steam cracking step e).

The steam cracking step e), and also the fractionation step d) prior to the steam cracking and the fractionation step f) following the steam cracking, are performed in a steam cracking unit 100 typically including a certain number of furnaces, quenching boilers and a fractionation train. The feedstock is composed of naphtha 61 and/or optionally of gas oil 62 obtained from the hydrocracking unit 60, optionally naphtha obtained from direct distillation 65 and/or optionally with naphtha 22 and/or gas oil 23 obtained from step 10, preferentially after a hydrotreatment step 70, and/or optionally unconverted vacuum gas oil 63 obtained from the hydrocracking unit 60. Other feedstocks may also be included, provided that they are compatible with the functioning of the steam cracking unit. The hydrocarbon-based feedstock enters the hot section and undergoes pyrolysis reactions. At the furnace outlet, the effluents are fixed in their kinetic evolution possibilities by abrupt quenching so as to avoid any subsequent reaction. The effluents are then transferred to a fractionation (step f) which separates the pyrolysis oil 105 and the other products such as ethylene 101, propylene 102, the C4 cut 103 and the steam cracking gasoline fraction rich in aromatic hydrocarbons 104. Step (g) according to the invention then sends all or some of the pyrolysis oil fraction 105, preferably all of said oil, according to the invention, into the hydroconversion step a) in the unit 10.

Figure 2:
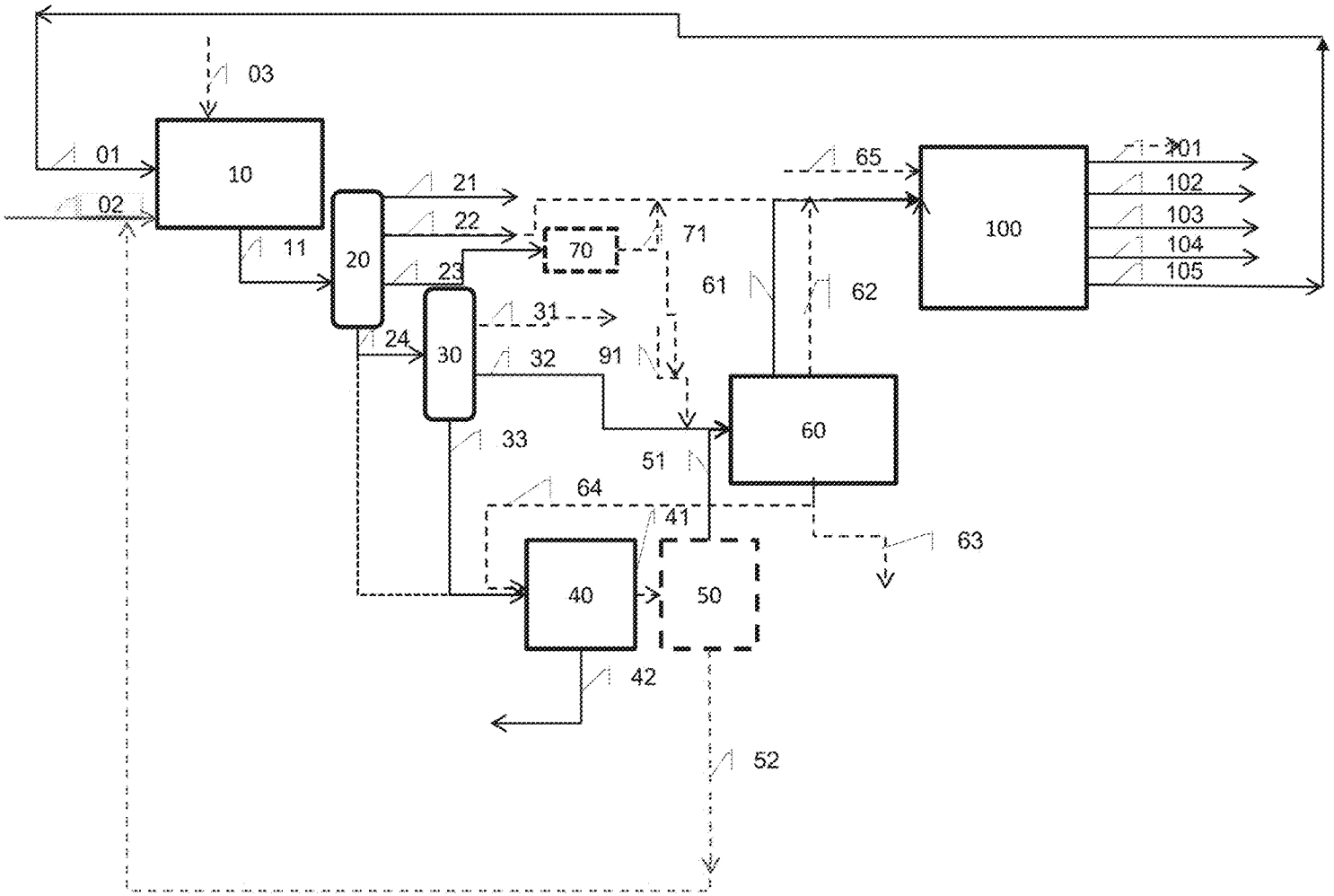
FIG. 2 illustrates the implementation of the process of the invention according to a first process variant.

As shown in FIG. 2, in a second embodiment of the process according to the invention, the implementation of the invention is identical to that described in FIG. 1 (same key for the streams, pipes and unit), the only difference being that a deasphalting step h) in a solvent deasphalting unit 40 (optionally including a second step 50) is performed on at least a portion of the unconverted vacuum residue 33 obtained from the fractionation column 30 of the deep hydroconversion unit 10, and/or optionally on a portion of the atmospheric residue 24 obtained from the atmospheric fractionation column 20.

When the deasphalting step h) is performed in a step 40, it produces, firstly, a deasphalted residue 41 which is sent via pipe 51 to the hydrocracking unit 60. The unit 40 produces, secondly, an asphalt 42 concentrating the majority of the contaminants of the vacuum residue VR obtained from the deep hydroconversion unit which has various possible destinations: for example, feeding a coking or gasification or visbreaking unit, or use as solid fuel (flaker) or liquid fuel or use as bitumen (unit 90).

When the deasphalting step h) is performed in two steps, namely a first step 40 followed by a second step 50 which treats the deasphalted residue 41, it produces a light deasphalted residue 51 which is particularly advantageous to treat in the hydrocracking unit 60, a heavy deasphalted residue which is particularly advantageous to recycle into the hydroconversion unit 10, and an asphalt stream 42.

In this second embodiment, the fixed-bed hydrocracking step c) 60 treats the light deasphalted residue 51, in addition to the feedstocks described previously: the vacuum gas oil 31 and 32 obtained from the hydroconversion unit 10, and also optionally the vacuum gas oil obtained by direct distillation of crude oil 91 (straight-run vacuum gas oil) and other compatible feedstocks. The hydrocracking unit 60 produces an effluent preferentially comprising significant amounts of naphtha 61 and/or gas oil 62 and lesser amounts of unconverted vacuum gas oil 63. It is preferentially performed in two stages, with purging of a small portion of the unconverted vacuum gas oil 63. A fraction 64 of said purge may be sent to the deasphalting step h) performed in two steps, since this stream is rich in polynuclear aromatic compounds, a portion of which is able to be recovered with the heavy deasphalted residue 52.

Figure 3:
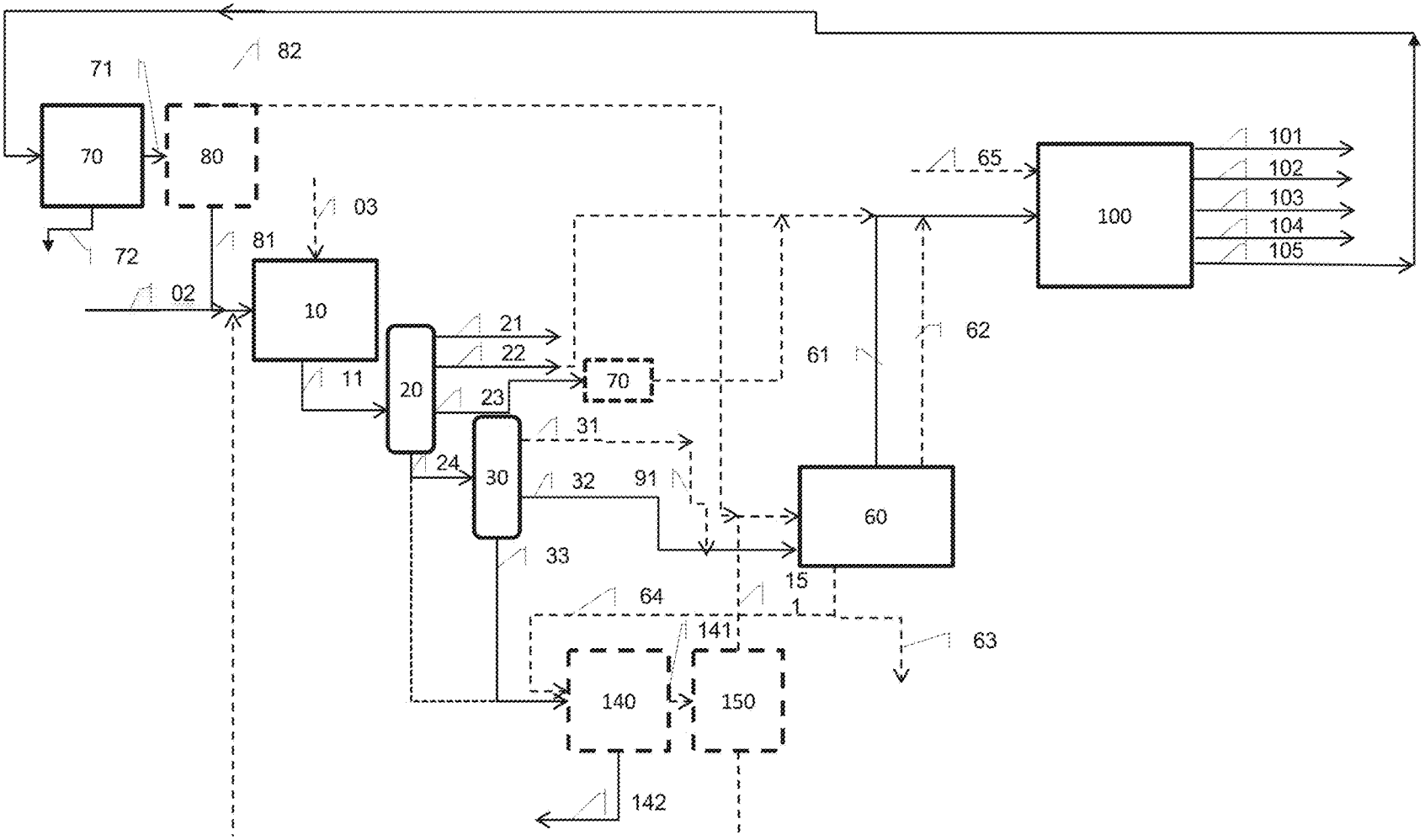
FIG. 3 illustrates the implementation of the process according to the invention according to a second process variant.

As shown in FIG. 3, in a third embodiment of the process according to the invention, the implementation of the invention is identical to that described in FIG. 2 (same key for the streams, pipes and unit), the only differences being that:

- a deasphalting step a') is performed on the pyrolysis oil fraction 105 obtained from the steam cracking unit 100;
- the deasphalting step h) may optionally be performed on at least a portion of the unconverted vacuum residue 33 obtained from the fractionation column 30 of the deep hydroconversion unit 10 and/or optionally on a portion of the atmospheric residue 24 obtained from the fractionation column 20.

When the deasphalting step a') is performed in a step 70, it produces, firstly, a deasphalted pyrolysis oil which is sent via pipe 81 to the hydroconversion unit 10. The unit 70 produces, secondly, a first residual asphalt 72 concentrating the majority of the asphaltenes of the pyrolysis oil obtained from the steam cracking unit.

When the deasphalting step a') is performed in two steps, a first step 70 followed by a second step 80 which treats the deasphalted pyrolysis oil obtained from step 70, it produces a light deasphalted pyrolysis oil 82 which it is particularly advantageous to treat in the hydrocracking unit 60, a heavy deasphalted pyrolysis oil 81 which it is particularly advantageous to treat in the hydroconversion unit 10, and a first residual asphalt 72.

Optionally, when the deasphalting step h) is performed in one step 140, it produces, firstly, a deasphalted unconverted residue 141 sent via pipe 151 to the hydrocracking unit 60, and, secondly, a second residual asphalt 142 concentrating the majority of the contaminants of the vacuum residue obtained from the hydroconversion unit, which has various possible destinations (unit 90): for example feed for a coking or gasification or visbreaking unit, or use as solid fuel ("flaker") or liquid fuel or use as bitumen.

When the deasphalting step h) is performed in two steps, a first step 140 followed by a second step 150 which treats the light fraction obtained from step 140, it produces a light deasphalted unconverted residue 151 which is sent to the hydrocracking unit 60, a heavy deasphalted unconverted residue 152 which is recycled into the hydroconversion unit 10, and a second final asphalt 142.

In this embodiment, the fixed-bed hydrocracking step 60 makes it possible optionally to convert the light deasphalted pyrolysis oil (first light DAO) 82 and/or the light deasphalted unconverted residue 151 and/or the deasphalted unconverted residue 141, in addition to the feedstocks described previously: the vacuum gas oil 31 and 32 obtained from the hydroconversion unit, and also optionally gas oil 23 obtained from the hydroconversion unit 10 and/or vacuum gas oil 32 obtained by direct distillation of crude oil 91 or other compatible feedstocks.

In this embodiment, the hydrocracking unit 60 produces an effluent comprising significant amounts of naphtha 61, gas oil 62 and unconverted vacuum gas oil 63. The hydrocracking unit 60 is preferentially operated in two stages, with a small portion of the unconverted vacuum gas oil 63 purged. A fraction 64 of this purged stream 63 can be sent to the deasphalting step 140.

Figure 4:
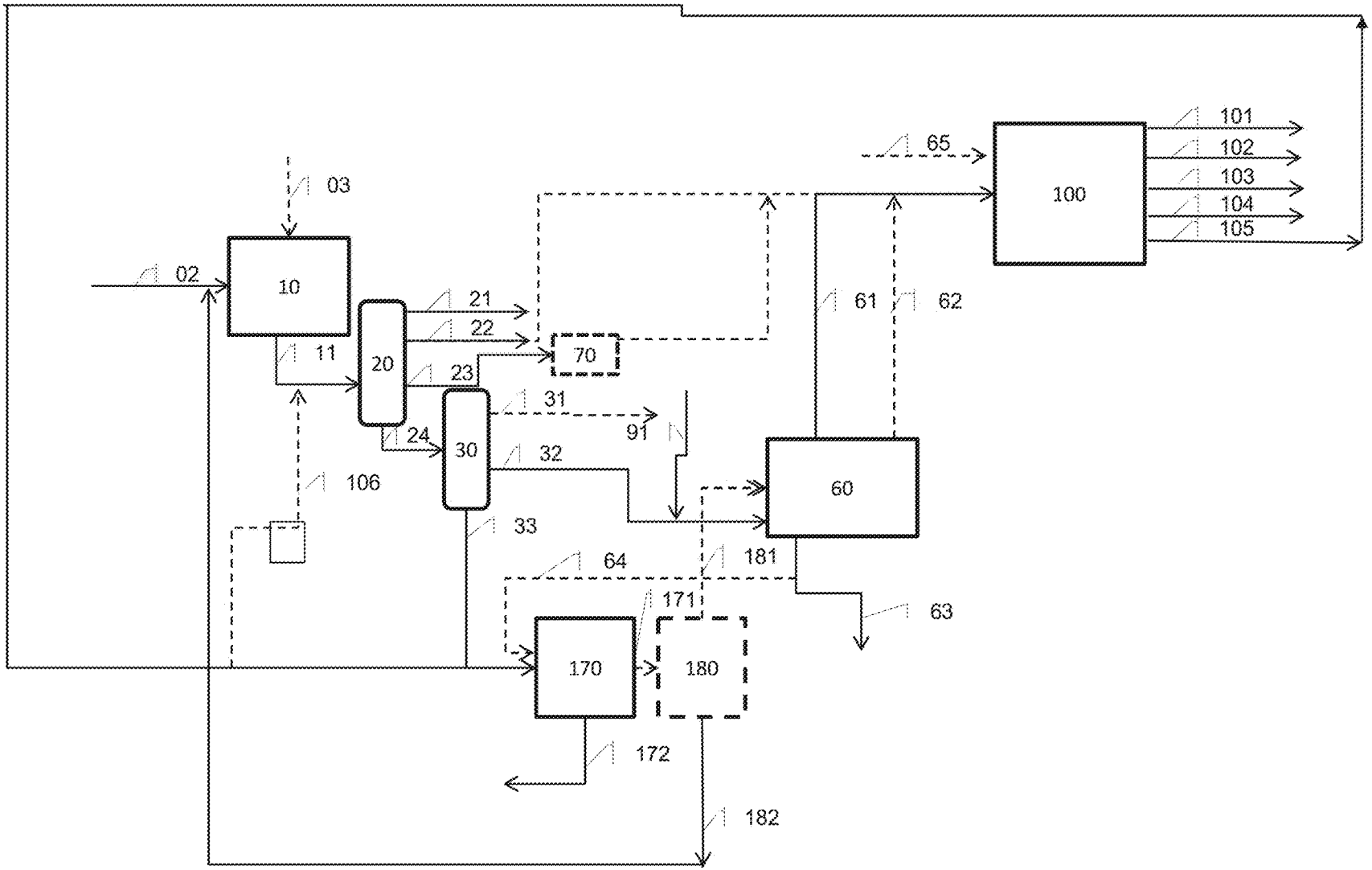
FIG. 4 illustrates the implementation of the process according to the invention according to a third process variant.

As shown in FIG. 4, in a fourth embodiment of the process according to the invention, the implementation of the invention is identical to that described in FIG. 2 (same key for the streams, pipes and unit), the only difference being that:

- a single deasphalting step i) is performed to deasphalt the pyrolysis oil 105 and at least a portion of the unconverted residue 33 obtained from the fractionation column 30 of the hydroconversion unit 10 and/or optionally a portion 64 of the purged unconverted vacuum gas oil obtained from the hydrocracking unit 60.

When the deasphalting step i) is performed in a step 170, it produces, firstly, a deasphalted oil 171, which is sent via pipe 181 to the hydrocracking unit 60. The unit 170 produces, secondly, an asphalt 172 concentrating the majority of the asphaltenes of the two treated fractions.

When the deasphalting step i) is performed in two steps, a first step 170 followed by a second step 180 which treats the light cut obtained from step 170, it produces a light deasphalted oil 181 which is sent to the hydrocracking unit 60, a heavy deasphalted oil 182 which is sent to the hydroconversion unit 10, and an asphalt 172.

The fixed-bed hydrocracking step 60 makes it possible to convert the light deasphalted oil 181, in addition to the feedstocks described previously, the vacuum gas oil 31 and 32 obtained from the deep hydroconversion unit, and also optionally vacuum gas oil obtained by direct distillation of crude oil 91.

A variant of FIG. 4 consists in providing an additional stream 106, as a dashed line in the figure, which corresponds to the injection of a portion of the pyrolysis oil 105 obtained from the unit 100 between the unit 10 and the unit 20, i.e. after the hydroconversion step a) and at the inlet of the separation step b). This additional stream 106 may also take up all the pyrolysis oil 105 obtained from the unit 100, and not a portion thereof. It has been shown that injecting pyrolysis oil at the end of step a) or at the inlet of step b) has a positive impact on the stability of the effluents obtained in the hydroconversion step, notably as regards the unconverted residue 33. Specifically, the pyrolysis oil makes it possible to reduce the precipitation of the asphaltenes contained in the heavy fractions obtained from the hydroconversion step.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding French application No. 19/07.744, filed Jul. 10, 2019, are incorporated by reference herein.

EXAMPLES

Example 1

This non-limiting example concerns an embodiment of the invention in accordance with FIG. 1. More particularly, it details the hydroconversion step a) according to the invention, and the type of feedstocks used according to the invention. An ebullated-bed hydroconversion unit corresponding to unit 10 of FIG. 1 treats a first feedstock consisting of pyrolysis oil obtained from a steam cracking unit treating naphtha and a second vacuum residue feedstock obtained from the distillation of a crude oil, having the properties detailed in Table 1 below. The two feedstocks are fed, in accordance with the invention, separately in the first hydroconversion reactor. The pyrolysis oil (the first feedstock) has a feed temperature T1 of about 100° C., and the vacuum residue (the second feedstock) has a feed temperature T2 of about 300° C. It should be noted that the pyrolysis oil described below may originate from step g) according to the invention or from any independent steam cracking unit, notably.

| Properties | Unit | Pyrolysis oil | Vacuum residue |
|---|---|---|---|
| Feedstock flow rate, t/h | t/h | 10 | 90 |
| Density | — | 1.050 | 1.027 |
| Conradson carbon | % by weight | 19.0 | 22.0 |
| C7 Asphaltenes | % by weight | 22.0 | 7.2 |
| Nitrogen | ppm by weight | 5 | 3530 |
| Sulfur | % by weight | 0.05 | 4.16 |
| Nickel | ppm by weight | <1 | 24 |
| Vanadium | ppm by weight | <1 | 85 |
| Dynamic viscosity at 40° C. | $mm^2/s$ | 1400 | |
| Dynamic viscosity at 100° C. | $mm^2/s$ | 120 | 1517 |
| Distillation | vol % | | |
| Initial boiling point | | 180 | 446 |
| 5% | ° C. | 210 | 529 |
| 10% | ° C. | 215 | 552 |
| 30% | ° C. | 260 | 613 |
| 50% | ° C. | 395 | 671 |
| 70% | ° C. | 505 | 730 |

-continued

| Properties | Unit | Pyrolysis oil | Vacuum residue |
|---|---|---|---|
| 90% | ° C. | 620 | — |
| 95% | ° C. | 700 | — |
| Content of unsaturated compounds | weight % | 20 | — |

Optionally, a catalytic precursor is added to the second vacuum residue feedstock so that the reaction takes place in the presence of a molecular or colloidal catalyst.

The operating conditions of the hydroconversion step are summarized in Table 2.

| Operating parameters | | Without precursor | With precursor |
|---|---|---|---|
| Conversion | wt % | 84.5 | 88.5 |
| Liquid HSV | $h^{-1}$ | 0.20 | 0.20 |
| Pressure | MPa | 18.0 | 18.0 |
| Mean temperature of the catalytic bed* | ° C. | 427 | 433 |
| $H_2$/Feedstock | $m^3/m^3$ | 650 | 650 |
| Catalysts | | $NiMo/Al_2O_3$ | $NiMo/Al_2O_3$ + HCAT precursor from the company HTI |

The liquid products obtained from the reactor are fractionated by atmospheric distillation as a naphtha fraction (C5+−150° C.), a gas oil fraction (150-370° C.) and a residual 370° C.+ fraction. The residual fraction is fractionated by vacuum distillation as a gas fraction which is sent to the fuel, a vacuum gas oil fraction VGO (370° C.-540° C.) and a 540° C.+ vacuum residue fraction.

Table 3 below presents the feedstock and the products of the hydroconversion unit with and without catalytic precursor for a conversion of 84.5% and 88.5% by weight, respectively.

| | Feedstock & Products | |
|---|---|---|
| | Without precursor | With precursor |
| Hydroconversion feedstocks: | | |
| Total feedstock, t/h | 100 | 100 |
| Hydrogen, t/h | 2.3 | 2.34 |
| precursor concentration/total feedstock, ppm by weight | 0 | 400 |
| Hydroconversion products | | |
| C1-C4, t/h | 4.9 | 5.3 |
| Naphtha, t/h | 9.7 | 10.6 |
| Gas oil (GO), t/h | 38.3 | 41.7 |
| Vacuum gas oil (VGO), t/h | 30.2 | 29.6 |
| Unconverted residue, t/h | 15.5 | 11.4 |

As shown in Table 3, the use of a catalytic precursor in the hydroconversion unit makes it possible to improve the conversion of the hydroconversion unit. Specifically, for the same cycle time of the unit, the conversion is 88.5% with precursor, instead of 84.5% without precursor. The yields of profitably exploitable light products are increased: 0.9% by weight for the amount of naphtha produced and 3.4% by weight for the amount of gas oil produced, whereas the amounts of vacuum gas oil and of unconverted vacuum residue decrease, respectively, by 0.6% by weight and 4.1% by weight.

Example 2

The feedstocks used in this example are identical to those of Example 1. They are used in a process according to one embodiment of the invention, as described in FIG. 1.

The feedstocks are treated in an ebullated-bed hydroconversion unit 10 as described in Example 1, and under the same operating conditions, without addition of catalytic precursor to the feedstock. The two feedstocks are fed separately. The products of the unit are treated in the same fractionation section.

The fixed-bed hydrocracking unit 60 treats the mixture of vacuum gas oil fraction 31 and of diesel fraction 23 produced. The hydrocracking unit 60 is operated in two stages under the operating conditions detailed in Table 4.

The vacuum residue 33 obtained from the hydroconversion unit is used as fuel oil. The hydrocracking unit produces an effluent which is sent to a fractionation section producing a naphtha fraction 61 and a gas oil fraction 62, which are sent to the steam cracking unit 100, and an unconverted vacuum gas oil fraction 63 which is purged.

The effluents from the steam cracking unit 100 are fractionated in a fractionation section, which separates the heavy residue known as the "pyrolysis oil" 105, sent as feedstock for the deep hydroconversion unit 10 and the other products such as ethylene 101, propylene 102, a C4 cut 103, and a steam cracking gasoline fraction rich in aromatic hydrocarbons 104.

The operating conditions of the hydrocracking units and of the steam cracking unit are summarized in Table 4 below.

| Operating parameters: | Unit | Hydrocracking | Steam cracking |
|---|---|---|---|
| HSV | $h^{-1}$ | 0.3 | — |
| Pressure | MPa | 18.0 | 0.5 |
| WABT/Temperature | ° C. | 400 | 800 |
| $H_2$/Feedstock | $m^3/m^3$ | 1400 | — |
| Conversion | wt % | 99.5% | — |

The sequence of the hydrocracking and steam cracking units downstream of the deep hydroconversion unit makes it possible to improve the yield of finished products very significantly, as shown in Table 7 later in the present text, in which the amounts of finished products of the various examples are compared.

As in Example 1, the use of a catalytic precursor in the hydroconversion unit 10 makes it possible to increase the amounts of profitably exploitable products produced (naphtha and gas oil) and to reduce the amounts of vacuum gas oil and residue produced in the same proportions as Example 1.

Example 3

The feedstocks used in this example are identical to those of Examples 1 and 2. They are used in a process according to one variant of the invention described in FIG. 2.

The feedstocks are treated in a deep hydroconversion unit 10 as in Example 1, and under the same operating conditions, without addition of catalytic precursor to the feedstock. The two feedstocks are fed separately to the first reactor. The products of the unit are treated in the same fractionation section. The hydrocracking unit 60 and the steam cracking unit 100 are operated by treating the same streams and under the same operating conditions as in Example 2, and produce the same effluents.

A unit for deasphalting with solvent in two steps (a first step 40 and a second step 50) treats the vacuum residue 33 obtained from the hydroconversion unit 10. The light deasphalted oil fraction 51 produced is sent to the hydrocracking unit 60 as a mixture with the vacuum gas oil fraction 31 and the diesel fraction 23 produced by the hydroconversion unit. The heavy deasphalted oil fraction 52 produced is recycled into the hydroconversion unit 10. The asphalt fraction 42 can be profitably exploited in specific units. The operating conditions of the selective deasphalting unit 40 and 50 are summarized in Table 5 below.

| Operating parameters | Units | First step | Second step |
|---|---|---|---|
| Pressure | MPa | 4.5 | 4.5 |
| Extractor temperature | | 120 at the top 90 at the bottom | 100 at the top 70 at the bottom |
| $H_2$/Feedstock | $m^3/m^3$ | — | — |
| Solvent/feedstock Extractor inlet | $m^3/m^3$ | 2/1 | 1.8/1 |
| Extractor bottom | $m^3/m^3$ | 4/1 | 4/1 |
| Solvent | | Propane and Pentane | Propane and Pentane |

The solvent used in the unit, both for the first step and for the second step, is a mixture of butane and pentane. The asphalt yield of the deasphalting unit is minimized to 30% by weight in order to maximize the conversion of the residue.

The addition of a selective deasphalting unit, in addition to the hydrocracking and steam cracking units downstream of the deep hydroconversion unit, as in Example 2, makes it possible to improve the yield of finished products, as shown in Table 7.

As in Example 1, the use of a catalytic precursor in the hydroconversion unit 10 makes it possible to increase the amounts of profitably exploitable products produced.

Example 4

Example 4 describes the implementation of the process according to one variant of the invention described in FIG. 3.

The feedstocks treated in the hydroconversion unit are a first feedstock composed of vacuum residue identical to that of Examples 1 and 2 and a second feedstock consisting of a deasphalted pyrolysis oil fraction 81. Specifically, the pyrolysis oil obtained from the steam cracker 105 undergoes solvent deasphalting in a conventional deasphalting unit 70 which produces an asphalt fraction 72 and a deasphalted pyrolysis oil fraction 81.

The feedstocks are fed separately. The deasphalted pyrolysis oil fraction 81 has a feed temperature T1 of about 100° C., and the vacuum residue has a feed temperature T2 of about 300° C. The feedstocks are then treated in a hydroconversion unit 10 similar to that of the preceding examples and under the same operating conditions, without addition of catalytic precursor. The products of the unit are treated in the same fractionation section. The hydrocracking unit 60 and the steam cracking unit 100 are operated by treating the same streams and under the same operating conditions as in Examples 1 and 2, and produce the same effluents.

The vacuum residue fraction 33 from the hydroconversion unit is profitably exploited as fuel.

The operating conditions of the conventional deasphalting unit 70 are summarized in Table 6 below.

| Operating parameters | Unit | Deasphalting |
|---|---|---|
| Pressure | MPa | 4.5 |
| Extractor temperature | | 120 at the top 90 at the bottom |
| $H_2$/Feedstock | $m^3/m^3$ | — |
| Solvent/feedstock Extractor inlet | $m^3/m^3$ | 2/1 |
| Extractor bottom | $m^3/m^3$ | 4/1 |
| Solvent | | Propane and Pentane |

The solvent used in the deasphalting unit 70 is a mixture of butane and pentane.

The asphalt yield of the deasphalting unit 70 is minimized to 30% by weight in order to maximize the conversion of the residue.

The addition of a deasphalting unit to the pyrolysis oil upstream of the deep hydroconversion unit makes it possible to reduce the capacity of the hydroconversion unit, thus reducing the necessary investment. It makes it possible to improve the yield of finished products, as shown in Table 7.

As in Example 1, the use of a catalytic precursor in the hydroconversion unit 10 makes it possible to increase the amounts of profitably exploitable products produced.

Example 5

Example 5 describes the implementation of the process according to one variant of the invention described in FIG. 4. The feedstocks treated in the hydroconversion unit are a second feedstock composed of vacuum residue identical to that of Examples 1 and 2 and a first heavy deasphalted oil feedstock 182 resulting from the deasphalting of the pyrolysis oil obtained from the steam cracker 100 as a mixture with the vacuum residue 33 obtained from the hydroconversion unit in a two-step deasphalting unit 170 and 180. The two feedstocks are fed separately. The first heavy deasphalted oil feedstock 182 resulting from the deasphalting of the pyrolysis oil obtained from the steam cracker 100 as a mixture with the vacuum residue 33 has a feed temperature T1 of about 100° C., and the vacuum residue has a feed temperature T2 of about 300° C.

The deasphalting unit also produces an asphalt fraction 172 and a light deasphalted oil fraction, which is sent to the hydrocracking unit 60.

The hydroconversion unit 10 is similar to that of the preceding examples, and operates under the same operating conditions, without addition of catalytic precursor. The products of the unit 10 are treated in the same fractionation section. The hydrocracking unit 60 and the steam cracking unit 100 are operated by treating the same streams and under the same operating conditions as in Example 3, and produce the same effluents.

The operating conditions of the deasphalting unit 170/180 are the same as those of Example 3. Treatment of the pyrolysis oil in a selective deasphalting unit in common with the vacuum residue makes it possible to improve the yield of finished products, as shown in Table 7, while at the same time minimizing the number of necessary units.

As in Example 1, the use of a catalytic precursor in the hydroconversion unit 10 makes it possible to increase the amounts of profitably exploitable products produced.

Table 7 below collates and compares the amounts of finished products of Examples 2 to 5:

| Products: | Example 2 without pre-cursor | Example 2 with pre-cursor | Example 3 | Example 4 | Example 5 |
|---|---|---|---|---|---|
| of the hydro-conversion step: | | | | | |
| C1-C4, t/h | 4.9 | 5.3 | 5.2 | 5.0 | 5.2 |
| Unconverted residue, t/h | 15.5 | 11.4 | None | 13.2 | None |
| of the hydro-cracking step: | | | | | |
| Unconverted vacuum gas oil, t/h | 0.7 | 0.7 | 0.8 | 0.7 | 0.8 |
| of the deas-phalting step: | | | | | |
| Asphalt, t/h | None | None | 4.1 | 1.0 | 4.9 |
| of the steam cracking step: | | | | | |
| Hydrogen, t/h | 2.4 | 2.4 | 2.5 | 2.4 | 2.5 |
| Methane, t/h | 35.5 | 36.0 | 37.3 | 36.2 | 37.0 |
| Ethylene, t/h | 71.0 | 72.0 | 74.5 | 72.5 | 74.0 |
| Propylene, t/h | 37.9 | 3.4 | 39.7 | 38.6 | 39.5 |
| Butene, t/h | 11.8 | 12.0 | 12.4 | 12.1 | 12.3 |
| Buta-1,3-diene, t/h | 4.7 | 4.8 | 5.0 | 4.8 | 4.9 |
| Pyrolysis gaso-line, t/h | 56.8 | 57.6 | 59.6 | 58.0 | 59.2 |

As shown in Table 7, the process according to the invention (with reference notably to Example 2) makes it possible to convert the pyrolysis oil and the feedstock as a mixture with which it is treated into profitably exploitable products (hydrogen, methane, ethylene, propylene, butene, butadienes and pyrolysis gasoline).

Furthermore, the injection of catalytic precursor into the process according to the invention makes it possible to increase the conversion in the hydroconversion unit by 4.8% by weight, leading to 1.5% by weight increase in the products of the steam cracking step.

As shown in Table 7:

in Example 3, the yields of profitably exploitable products obtained from the steam cracking step increase by 5% by weight relative to Example 2, partly by means of the profitable exploitation of the unconverted residue obtained from the hydroconversion step 10 in the hydrocracking step 60 after a two-step deasphalting step 40&50;

in Example 4, the yields of profitably exploitable products obtained from the steam cracking step increase by 2.1% by weight relative to Example 2, by means of step 70 of one-step deasphalting of the pyrolysis oil fraction upstream of the deep hydroconversion step 10;

in Example 5, the yields of profitably exploitable products obtained from the steam cracking step increase by 4% relative to Example 2, by means of step 170 and 180 of two-step deasphalting treating the pyrolysis oil fraction and the unconverted residue fraction.

Example 6

Example 6 describes the implementation of the process according to another variant of the invention described in FIG. 4, using a vacuum residue stream obtained from the distillation of a crude oil and a pyrolysis oil stream obtained from a steam cracking unit treating naphtha, which are both identical to the feedstocks of Example 1.

An ebullated-bed hydroconversion unit corresponding to unit 10 of FIG. 4 treats a vacuum residue feedstock 02. The hydroconversion unit 10 is similar to that of the preceding examples, and operates under the same operating conditions, without addition of catalytic precursor. It treats only one feedstock.

The products of unit 10 are treated in the same fractionation section as the preceding examples, but the second stream consisting of pyrolysis oil 105 obtained from the steam cracking unit 100 is fed here via a pipe 106 at the end of the hydroconversion step a) and to the inlet of the separation step b), this separation step notably corresponding to the fractionation units 20 and 30 of FIG. 4. The addition of pyrolysis oil makes it possible to stabilize the effluents of the hydroconversion step, notably the unconverted residue 33, i.e. to limit the precipitation of asphaltenes in the lines and equipment in which the unconverted residue passes.

This is shown by comparison of the result of the analyses of sediments (IP 375 and IP 390):

of an unconverted residue/pyrolysis oil mixture comprising between 10% and 50% by weight of pyrolysis oil and of the unconverted residue alone.

The sediment content is, effectively, reduced to one third in the mixture relative to the sediment content in the unconverted residue alone. Furthermore, the sediment content of the mixture is strictly less than 0.2% by weight. As a result, little fouling of the associated equipment and lines is obtained.

In conclusion, the invention enables profitable exploitation of the pyrolysis oil obtained from steam cracking, in a very flexible manner since it proposes numerous advantageous variants, which may be selected as a function notably of the available installations: the pyrolysis oil may originate from the actual steam cracking unit used in the process of the invention, or from another steam cracking unit. It may also have undergone, or otherwise, treatments such as deasphalting, alone or in combination with other residues produced during the process according to the invention. While the pyrolysis oil is generally, according to the invention, introduced into the hydroconversion step a), so as to convert it, it may also be introduced, totally or partly, later in the process, at the end of hydroconversion or during the following separation step, for the purpose of stabilizing effluents downstream in the process. It may consist of only one type of pyrolysis oil or of one or more cuts obtained from different prior treatments/different sources.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for converting a first feedstock comprising pyrolysis oil obtained from a steam cracking unit and a second heavy hydrocarbon-based feedstock having an initial boiling point of at least 550° C., said process comprising the following steps:

a) a step of hydroconverting said feedstocks in at least one reactor, in the presence of hydrogen and of at least one hydroconversion catalyst, with the reactor being fed with the first feedstock at a feed temperature T1 of between 80 and 200° C. and, separately, with the second feedstock at a feed temperature T2 greater than 250° C., producing a hydroconverted liquid effluent;

b) a step of separating at least a portion of the hydroconverted liquid effluent obtained from step a) into at least a naphtha fraction, a gas oil fraction, a vacuum gas oil fraction and an unconverted residue fraction;

c) a hydrocracking step in a fixed-bed reactor in the presence of a catalyst for hydrocracking at least a portion of the vacuum gas oil fraction obtained from step b), producing a hydrocracked liquid effluent;

d) a step of fractionating at least a portion of the hydrocracked liquid effluent obtained from step c) into a naphtha fraction, a gas oil fraction and an unconverted vacuum gas oil fraction;

e) a step of steam cracking of at least a portion of the naphtha fraction obtained from step d) and optionally of a portion of the unconverted vacuum gas oil fraction obtained from step d) to obtain a steam-cracked effluent;

f) a step of fractionating at least a portion of the steam-cracked effluent obtained from step e) into an ethylene fraction, a propylene fraction, a butadiene and C4 olefin fraction, a pyrolysis gasoline fraction and a pyrolysis oil fraction;

g) a step in which at least a portion of the pyrolysis oil fraction obtained from step f) is sent into the hydroconverting step a).

2. The process according to claim 1, wherein, in step g), the pyrolysis oil fraction obtained from step f) is sent to the hydroconverting step a), either directly or after at least one intermediate treatment chosen from deasphalting and steam stripping and/or hydrogen stripping.

3. The process according to claim 1, wherein the first feedstock comprising pyrolysis oil obtained from a steam cracking unit is introduced at the end of the hydroconverting step a).

4. The process according to claim 1, wherein the hydroconverting step a) in the presence of hydrogen is performed in at least one ebullated-bed three-phase reactor.

5. The process according to claim 1, which also comprises a step h) of deasphalting by liquid/liquid extraction of at least a portion of the unconverted residue fraction from step b), so as to obtain an asphalt phase and a deasphalted unconverted residue, said deasphalted unconverted residue being at least partly sent to the hydrocracking step c).

6. The process according to claim 5, wherein the deasphalting step h) is performed in two successive steps so as to obtain an asphalt phase, a light deasphalted unconverted residue and a heavy deasphalted unconverted residue, said light deasphalted unconverted residue being sent at least partly to the hydrocracking step c), said heavy deasphalted unconverted residue being sent at least partly to step a) in the second feedstock.

7. The process according to claim 1, which also comprises a step a') of deasphalting the pyrolysis oil fraction obtained from the fractionating step f), so as to obtain an asphalt phase and a deasphalted pyrolysis oil, said deasphalted pyrolysis oil being at least partly sent to the hydroconverting step a) as first feedstock.

8. The process according to claim 7, wherein the pyrolysis oil deasphalting step a') is performed by liquid/liquid extraction in two steps, so as to obtain an asphalt phase, a light deasphalted pyrolysis oil and a heavy deasphalted pyrolysis oil, said light deasphalted pyrolysis oil being at least partly or totally sent to the hydrocracking step c), and said heavy deasphalted pyrolysis oil being at least partly sent to the hydroconverting step a) in the first feedstock.

9. The process according to claim 1, which also comprises a step i) of deasphalting by liquid/liquid extraction of the pyrolysis oil obtained from step f) and of at least a portion of the unconverted residue obtained from step b), so as to obtain an asphalt phase and a deasphalted oil DAO cut, said deasphalted oil cut being at least partly sent to the hydroconverting step a) in the first feedstock.

10. The process according to claim 9, wherein the deasphalting step i) is performed by liquid/liquid extraction in two steps, so as to obtain an asphalt phase, a light deasphalted oil cut and a heavy deasphalted oil cut, said light deasphalted oil cut being at least partly sent to the hydrocracking step c), and said heavy deasphalted oil cut being at least partly or totally sent to the hydroconverting step a) in the first feedstock.

11. The process according to claim 1, wherein the hydroconverting step a) is performed in the presence of a colloidal or molecular catalyst, and in the presence of a porous supported catalyst.

12. The process according to claim 1, which also comprises at least one of the following additional steps:

a hydrotreatment step j), performed in a reactor in the presence of at least one fixed-bed hydrotreatment catalyst, of at least a portion of the naphtha fraction obtained from step b), optionally followed by a step k) of recycling of at least a portion of the hydrotreated naphtha fraction obtained from step j) into the steam cracking step e);

a hydrotreatment step l), performed in a reactor in the presence of at least one fixed-bed hydrotreatment catalyst, of at least a portion of the gas oil fraction obtained from step b), optionally followed by a step m) of recycling of at least a portion of the hydrotreated gas oil fraction obtained from step l) into the hydrocracking step c).

13. The process according to claim 1, wherein the proportion of pyrolysis oil of the first feedstock relative to the total feedstock of the hydroconverting step a) is greater than or equal to 5% by weight.

14. The process according to claim 13, wherein the proportion of pyrolysis oil of the first feedstock relative to the total feedstock of the hydroconverting step a) is 5% to 50% by weight.

15. The process according to claim 13, wherein the proportion of pyrolysis oil of the first feedstock relative to the total feedstock of the hydroconverting step a) is 5% to 25% or 40% by weight.

16. The process according to claim 13, wherein the proportion of pyrolysis oil of the first feedstock relative to the total feedstock of the hydroconverting step a) is 5% to 25% by weight.

17. The process according to claim 1, wherein the proportion of pyrolysis oil of the first feedstock relative to the total feedstock of the hydroconverting step a) is greater than or equal to 10% by weight.

18. The process according to claim 1, wherein the second feedstock of the hydroconverting step a) comprises hydrocarbons chosen from at least one of the following hydrocarbons: hydrocarbons obtained from the atmospheric distillation or vacuum distillation of crude oil, residual fraction obtained from the direct liquefaction of coal, vacuum gas oil, residual fraction obtained from the direct liquefaction of lignocellulosic biomass alone or as a mixture with coal, residual petroleum fraction.

19. A process for converting a first feedstock comprising pyrolysis oil obtained from a steam cracking unit and a second heavy hydrocarbon-based feedstock having an initial boiling point of at least 550° C., said process comprising the following steps:

a) a step of hydroconverting said feedstocks in at least one reactor, in the presence of hydrogen and of at least one hydroconversion catalyst, the reactor being fed with a part of the first feedstock at a feed temperature T1 of between 80 and 200° C. and, separately, with the second feedstock at a feed temperature T2 greater than 250° C., producing a hydroconverted liquid effluent;

b) a step of separating at least a portion of the hydroconverted liquid effluent obtained from step a) into at least a naphtha fraction, a gas oil fraction, a vacuum gas oil fraction and an unconverted residue fraction while adding the rest of the first feedstock;

c) a hydrocracking step in a fixed-bed reactor in the presence of a catalyst for hydrocracking at least a portion of the vacuum gas oil fraction obtained from step b), producing a hydrocracked liquid effluent;

d) a step of fractionating at least a portion of the hydrocracked liquid effluent obtained from step c) into a naphtha fraction, a gas oil fraction and an unconverted vacuum gas oil fraction;

e) a step of steam cracking of at least a portion of the naphtha fraction obtained from step d) and optionally of a portion of the unconverted vacuum gas oil fraction obtained from step d) to obtain a steam-cracked effluent;

f) a step of fractionating at least a portion of the steam-cracked effluent obtained from step e) into an ethylene fraction, a propylene fraction, a butadiene and C4 olefin fraction, a pyrolysis gasoline fraction and a pyrolysis oil fraction;

g) a step in which at least a portion of the pyrolysis oil fraction obtained from step f) is sent into the hydroconverting step a).

* * * * *